US011542937B2

(12) United States Patent
Imai

(10) Patent No.: US 11,542,937 B2
(45) Date of Patent: Jan. 3, 2023

(54) TUBE PUMP SYSTEM AND METHOD FOR CONTROLLING THE TUBE PUMP SYSTEM

(71) Applicant: Surpass Industry Co., Ltd., Saitama (JP)

(72) Inventor: Yukinobu Imai, Saitama (JP)

(73) Assignee: Surpass Industry Co., Ltd., Saitama (JP)

( * ) Notice: Subject to any disclaimer, the term of this patent is extended or adjusted under 35 U.S.C. 154(b) by 218 days.

(21) Appl. No.: 16/786,407

(22) Filed: Feb. 10, 2020

(65) Prior Publication Data

US 2020/0263682 A1 Aug. 20, 2020

(30) Foreign Application Priority Data

Feb. 15, 2019 (JP) ..... JP2019-025682

(51) Int. Cl.
*F04B 49/20* (2006.01)
*F04B 43/00* (2006.01)
(Continued)

(52) U.S. Cl.
CPC ..... *F04B 49/20* (2013.01); *F04B 43/0081* (2013.01); *F04B 43/09* (2013.01);
(Continued)

(58) Field of Classification Search
CPC ..... F04B 49/20; F04B 49/08; F04B 43/09; F04B 43/1253; F04B 43/12
See application file for complete search history.

(56) References Cited

U.S. PATENT DOCUMENTS 3,649,138 A 3/1972 Clay et al.
3,726,613 A 4/1973 Von Casimir
(Continued)

FOREIGN PATENT DOCUMENTS

DE 20109803 U1 10/2002
EP 1942964 A2 7/2008
(Continued)

OTHER PUBLICATIONS

Extended European Search Report for Application No. 21055305.4, entitled: Tube Pump System and Method for Controlling the Tube Pump System, dated May 8, 2020.
(Continued)

*Primary Examiner* — Christopher S Bobish
(74) *Attorney, Agent, or Firm* — Hamilton, Brook, Smith & Reynolds, P.C.

(57) ABSTRACT

Provided is a tube pump system which includes: a pair of roller units which are rotated around an axis line from a closing position to a releasing position; a pair of drive units which are configured to respectively rotate the pair of roller units; a control unit which is configured to control each of the pair of drive units; and a pressure sensor which is configured to detect a pressure of a liquid in a pipe connected to the other end of the tube, wherein the control unit controls a first rotation angle when the first roller unit passes through the closing position and a second rotation angle when the second roller unit passes through the releasing position such that fluctuation of the pressure of the liquid when the pair of roller units are rotated through at least one revolution falls within a predetermined value.

10 Claims, 19 Drawing Sheets

(51) Int. Cl.
*F04B 43/12* (2006.01)
*F04B 49/08* (2006.01)
*F04B 43/09* (2006.01)

(52) U.S. Cl.
CPC ..... *F04B 43/12* (2013.01); *F04B 43/1253* (2013.01); *F04B 49/08* (2013.01); *F04B 2201/021* (2013.01); *F04B 2201/02011* (2013.01); *F04B 2205/05* (2013.01)

(56) References Cited

U.S. PATENT DOCUMENTS

| | | | | |
|---|---|---|---|---|
| 3,756,752 | A | 9/1973 | Stenner | |
| 3,826,593 | A | 7/1974 | Von Casimir | |
| 3,938,909 | A | 2/1976 | Willock | |
| 3,985,019 | A | 10/1976 | Boehme et al. | |
| 4,496,295 | A | 1/1985 | King | |
| 4,705,464 | A | 11/1987 | Arimond | |
| 5,388,972 | A | 2/1995 | Calhoun et al. | |
| 5,533,877 | A | 7/1996 | Friedmann et al. | |
| 5,586,872 | A * | 12/1996 | Skobelev | F04B 43/1253 417/477.8 |
| 5,640,181 | A | 6/1997 | Uchida et al. | |
| 5,657,000 | A | 8/1997 | Ellingboe | |
| 5,971,726 | A | 10/1999 | Yoshida et al. | |
| 6,264,634 | B1 | 7/2001 | Yamazaki | |
| 7,645,127 | B2 | 1/2010 | Hagen et al. | |
| 10,082,136 | B2 | 9/2018 | Imai et al. | |
| 10,465,673 | B2 | 11/2019 | Ackermann et al. | |
| 10,528,064 | B2 | 1/2020 | Imai et al. | |
| 10,746,168 | B2 | 8/2020 | Imai et al. | |
| 2004/0057856 | A1 | 3/2004 | Saxer et al. | |
| 2005/0019185 | A1 | 1/2005 | Otis, Jr. | |
| 2006/0245964 | A1 | 11/2006 | Koslov | |
| 2008/0213113 | A1 | 9/2008 | Lawrence et al. | |
| 2009/0053084 | A1 | 2/2009 | Klein | |
| 2011/0033318 | A1 | 2/2011 | Ramirez, Jr. et al. | |
| 2013/0072871 | A1 | 3/2013 | Ozturk | |
| 2013/0280104 | A1 | 10/2013 | Heide et al. | |
| 2013/0315763 | A1 | 11/2013 | Neoh et al. | |
| 2015/0159642 | A1 | 6/2015 | Sasa et al. | |
| 2015/0240802 | A1 | 8/2015 | Guthrie et al. | |
| 2015/0330385 | A1 | 11/2015 | Lofstrom et al. | |
| 2016/0245271 | A1 * | 8/2016 | Schaefer | F04B 43/1253 |
| 2016/0265519 | A1 | 9/2016 | Igarashi | |
| 2017/0028117 | A1 | 2/2017 | Mochizuki | |
| 2017/0051735 | A1 | 2/2017 | Gaskill-Fox et al. | |
| 2017/0096995 | A1 | 4/2017 | Imai et al. | |
| 2018/0066646 | A1 | 3/2018 | Himmelmann | |
| 2018/0074525 | A1 | 3/2018 | Imai et al. | |
| 2018/0128266 | A1 * | 5/2018 | Gaskill-Fox | F04B 49/065 |
| 2018/0230987 | A1 | 8/2018 | Imai et al. | |
| 2019/0136853 | A1 | 5/2019 | Bach | |
| 2019/0234394 | A1 | 8/2019 | Gledhill, III et al. | |
| 2019/0285064 | A1 | 9/2019 | Imai et al. | |
| 2020/0208624 | A1 | 7/2020 | Wang et al. | |
| 2021/0239108 | A1 | 8/2021 | Imai | |
| 2021/0372392 | A1 | 12/2021 | Imai | |
| 2021/0372393 | A1 | 12/2021 | Imai | |

FOREIGN PATENT DOCUMENTS

| | | | |
|---|---|---|---|
| EP | 2397695 | A1 | 12/2011 |
| EP | 3543532 | A1 | 9/2019 |
| JP | S52112805 | A | 9/1977 |
| JP | S56129790 | A | 10/1981 |
| JP | S5773882 | A | 5/1982 |
| JP | 2000-205201 | A | 7/2000 |
| JP | 2008308994 | A | 12/2008 |
| JP | 2014214614 | A | 11/2014 |
| JP | 2016169620 | A | 9/2016 |
| JP | 2017062247 | A | 3/2017 |
| JP | 2017067054 | A | 4/2017 |
| JP | 2018044488 | A | 3/2018 |
| JP | 2018131946 | A | 8/2018 |

OTHER PUBLICATIONS

U S. Non-Final Office Action for U.S. Appl. No. 16/295,319, entitled Tube Pump System and Method for Controlling the Tube Pump System, dated Sep. 11, 2020.

European Extended Search Report dated Nov. 27, 2017 for European Application No. 17190606.8-1616, entitled "Tube Pump System and Method for Controlling the Tube Pump System".

European Search Report for European Application No. 19162820.5, entitled Tube Pump System and Method for Controlling the Tube Pump System, dated Jul. 15, 2019.

Extended European Search Report for Application No. 21151557.2, entitled: "Tube Pump," dated Mar. 29, 2021.

European Search Report received in EP Application No. 21174877.7 entitled, "Tube Pump System," dated Sep. 24, 2021.

European Search Report received in EP Application No. 21175039.3 entitled, "Tube Holding Member and Tube Pump," dated Nov. 25, 2021.

* cited by examiner

TUBE PUMP SYSTEM AND METHOD FOR CONTROLLING THE TUBE PUMP SYSTEM

CROSS-REFERENCE TO RELATED APPLICATIONS

This application claims priority under 35 U.S.C. § 119 or 365 to Japanese, Application No. 2019-025682, filed Feb. 15, 2019. The entire teachings of the above application are incorporated herein by reference.

BACKGROUND OF THE INVENTION

1. Field of the Invention

The present disclosure relates to a tube pump system and a method for controlling the tube pump system.

2. Description of Related Art

Conventionally, a tube pump has been known where a tube having flexibility is intermittently compressed by a plurality of rollers so as to supply a liquid in the tube under pressure. The tube pump intermittently supplies the liquid under pressure and hence, pulsation (an operation where an increase and a decrease in flow rate is repeated) is generated in the liquid supplied under pressure.

Japanese Unexamined Patent Application, Publication No. 2018-44488 (patent document 1) discloses the following problem. When a tube compressed by a roller returns to the original shape, pulsation is generated due to a phenomenon that a liquid is drawn back toward the tube pump side from a path on the downstream side. Patent document 1 discloses a technique where, to suppress such pulsation, when one of a pair of roller units passes through a separation position, at which the roller unit separates from the tube, the pressure of a liquid in the tube closed due to contact with the pair of roller units is caused to rise. According to patent document 1, the pressure of a liquid in the tube is caused to rise and hence, it is possible to suppress the phenomenon that a liquid is drawn back toward the tube pump side.

BRIEF SUMMARY OF THE INVENTION

When the flow rate of a liquid discharged from a tube pump system is set to an arbitrary target flow rate which is instructed by an operator or the like, the pressure of a liquid in a pipe on the downstream side of the tube pump system varies corresponding to the variation of the target flow rate. Accordingly, the pulsation state also varies with such variation of the pressure of the liquid. In addition to the above, when the hardness or the like of the tube varies due to continuous use of the tube, the pulsation state also varies with such variation of hardness.

However, patent document 1 fails to disclose a specific method for suppressing pulsation when such dynamic variation occurs in the pulsation state.

The present disclosure has been made in view of such circumstances, and an object thereof is to provide a tube pump system and a method for controlling the tube pump system where even when the pulsation state dynamically varies, pulsation can be appropriately suppressed in accordance with such variation.

To solve the above-described problem, a tube pump system of the present disclosure employs the following solutions.

According to one aspect of the present disclosure, there is provided a tube pump system including: a housing unit which has an inner peripheral surface formed into a circular-arc shape around an axis line; a tube having flexibility which is arranged along the inner peripheral surface; a pair of roller units which are housed in the housing unit, and are rotated around the axis line from a closing position to a releasing position around the axis line in a state where the pair of roller units close the tube; a pair of drive units which are configured to respectively rotate the pair of roller units around the axis line in a same direction; a control unit which is configured to control each of the pair of drive units such that a liquid which flows into the tube from one end of the tube is discharged from the other end of the tube; and a pressure detection unit which is configured to detect a pressure of a liquid in a pipe connected to the other end of the tube, wherein the control unit is configured to control a first rotation angle around the axis line and a second rotation angle around the axis line such that fluctuation of the pressure of the liquid detected by the pressure detection unit when the pair of roller units are rotated through at least one revolution falls within a predetermined value, the first rotation angle being formed between the pair of roller units when a first roller unit of the pair of roller units passes through the closing position, and the second rotation angle being formed between the pair of roller units when a second roller unit of the pair of roller units passes through the releasing position.

According to the tube pump system of one aspect of the present disclosure, the pair of roller units are respectively rotated by the pair of drive units around the axis line in the same direction and hence, the pair of roller units reach the releasing position from the closing position in a state of compressing the tube. The control unit controls each of the pair of drive units, thus causing a liquid which flows into the tube from one end of the tube to be discharged from the other end of the tube. The fluctuation of the pressure of a liquid detected by the pressure detection unit when the pair of roller units rotate through at least one revolution indicates the magnitude of the pulsation of a liquid supplied by the tube pump system under pressure. When one of the pair of roller units passes through the releasing position and the tube compressed by the roller unit returns to the original shape, the larger a pressure difference between the pressure of liquid on the downstream side of the releasing position and the pressure of liquid on the upstream side of the releasing position, the larger the fluctuation of the pressure becomes.

The pressure difference between liquid on the downstream side of the releasing position and liquid on the upstream side of the releasing position corresponds to the first rotation angle and the second rotation angle. That is, the larger a difference between the first rotation angle and the second rotation angle, the higher the pressure of a liquid in the tube which is closed by contact with the pair of roller units becomes. The smaller a difference between the first rotation angle and the second rotation angle, the lower the pressure of a liquid in the tube which is closed by contact with the pair of roller units becomes. Accordingly, in the tube pump system according to one aspect of the present disclosure, the control unit controls the first rotation angle around the axis line and the second rotation angle around the axis line such that the fluctuation of a pressure detected by the pressure detection unit falls within a predetermined value, the first rotation angle being formed between the pair of roller units when the first roller unit passes through the closing position, and the second rotation angle being formed between the pair of roller units when the second roller unit passes through the releasing position. According to the tube pump system of one aspect of the present disclosure, even when the pulsation state dynamically varies, pulsation can be appropriately suppressed in correspondence with such variation.

In the tube pump system according to one aspect of the present disclosure, it may be configured such that the control unit performs control such that the second rotation angle becomes smaller than the first rotation angle.

According to the tube pump system having this configuration, a rotation angle formed between the pair of roller units which close the tube is reduced to the rotation angle formed between a point where the closed state of the tube is started and a point where the closed state of the tube is released. Accordingly, it is possible to cause the pressure of a liquid in the tube to rise to a desired pressure.

In the tube pump system having the above-mentioned configuration, it may be configured such that the control unit increases an angular velocity of the first roller unit from a first predetermined velocity to a second predetermined velocity in a period from a point where the first roller unit passes through the closing position to a point where the second roller unit passes through the releasing position.

According to the tube pump system having this configuration, the angular velocity of the following first roller unit is increased from the first predetermined velocity to the second predetermined velocity and hence, the rotation angle formed between the pair of roller units which close the tube is reduced to the rotation angle formed between a point where the closed state of the tube is started and a point where the closed state of the tube is released. Accordingly, a pressure difference between the pressure of liquid on the downstream side of the releasing position and the pressure of liquid on the upstream side of the releasing position is decreased and hence, pulsation of the liquid is suppressed.

In the tube pump system having the above-mentioned configuration, the control unit may control the pair of drive units such that, as the fluctuation falls within a predetermined value, an angular velocity of the first roller unit which moves toward the releasing position is gradually decreased after the second roller unit passes through the releasing position.

In the case where the first roller unit is rotated at a fixed angular velocity after the second roller unit passes through the releasing position, a distance from a position where the first roller unit compresses the tube to the releasing position gradually decreases. Accordingly, the pressure of liquid on the upstream side of the releasing position rises as the first roller unit approaches the releasing position. In view of the above, in the tube pump system having this configuration, after the second roller unit passes through the releasing position, an angular velocity of the first roller unit which moves toward the releasing position is gradually decreased.

Accordingly, the pressure rise of liquid on the upstream side which is caused by approach of the first roller unit to the releasing position can be offset by a decrease in the pressure of liquid which is caused by a decrease in the angular velocity of the first roller unit. Further, according to the tube pump system having this configuration, control is performed such that, after the fluctuation of the pressure of liquid falls within a predetermined value, the angular velocity of the first roller unit which moves toward the releasing position is gradually decreased. According to the tube pump system having this configuration, pulsation can be promptly suppressed with high accuracy compared with the case where such control is performed when the fluctuation of the pressure of liquid is larger than the predetermined value.

In the tube pump system having the above-mentioned configuration, the control unit may adjust the angular velocity of each of the pair of roller units corresponding to the first rotation angle such that a flow rate per unit time of a liquid discharged from the other end of the tube is maintained at a predetermined flow rate.

In the tube pump system having this configuration, the control unit adjusts the first rotation angle and the second rotation angle such that the fluctuation of a pressure falls within a predetermined value to suppress pulsation. However, when the flow rate of a liquid varies to suppress pulsation, the pressure of liquid in the pipe on the downstream side of the tube pump system varies corresponding to the variation of the flow rate of a liquid. The pulsation state also varies with this variation of pressure of liquid so that variations of the flow rate and pulsation are repeated whereby it becomes difficult to appropriately suppress pulsation within a short time.

In view of the above, in the tube pump system having this configuration, the control unit adjusts the angular velocity of each of the pair of roller units corresponding to the first rotation angle such that the flow rate per unit time of a liquid discharged from the other end of the tube is maintained at a predetermined flow rate. Accordingly, for example, even when the first rotation angle and the second rotation angle are controlled to suppress pulsation, the flow rate per unit time of a liquid discharged from the other end of the tube is maintained at a predetermined flow rate. Therefore, it is possible to suppress that the pulsation state varies with variation of the flow rate of a liquid and hence, pulsation can be appropriately suppressed within a short time.

According to one aspect of the present disclosure, there is provided a method for controlling a tube pump system including: a housing unit which has an inner peripheral surface formed into a circular-arc shape around an axis line; a tube having flexibility which is arranged along the inner peripheral surface; a pair of roller units which are housed in the housing unit, and are rotated around the axis line from a closing position to a releasing position around the axis line in a state where the pair of roller units compress the tube; and a pair of drive units which are configured to respectively rotate the pair of roller units around the axis line in a same direction, the method including: a controlling step where each of the pair of drive units is controlled such that a liquid which flows into the tube from one end of the tube is discharged from the other end of the tube; and a pressure detecting step where a pressure of a liquid in a pipe connected to the other end of the tube is detected, wherein in the controlling step, a first rotation angle around the axis line and a second rotation angle around the axis line are controlled such that fluctuation of the pressure of the liquid detected in the pressure detecting step when the pair of roller units are rotated through at least one revolution falls within a predetermined value, the first rotation angle being formed between the pair of roller units when a first roller unit of the pair of roller units passes through the closing position, and the second rotation angle being formed between the pair of roller units when a second roller unit of the pair of roller units passes through the releasing position.

In the method for controlling a tube pump system according to one aspect of the present disclosure, in the controlling step, the first rotation angle around the axis line and the second rotation angle around the axis line are controlled such that fluctuation of the pressure detected in the pressure detecting step falls within a predetermined value, the first rotation angle being formed between the pair of roller units when the first roller unit passes through the closing position, and the second rotation angle being formed between the pair of roller units when the second roller unit passes through the releasing position. According to the method for controlling a tube pump system of one aspect of the present disclosure, even when the pulsation state dynamically varies, pulsation can be appropriately suppressed in correspondence with such variation.

It is an object of the present disclosure to provide a tube pump system and a method for controlling the tube pump system where even when the pulsation state dynamically varies, pulsation can be appropriately suppressed in correspondence with such variation.

DETAILED DESCRIPTION OF THE INVENTION

Hereinafter, a tube pump system and a method for controlling the tube pump system according to one embodiment of the present disclosure are explained with reference to drawings.

Hereinafter, a tube pump system 700 according to one embodiment of the present disclosure will be explained with reference to drawings.

The tube pump system 700 of this embodiment is an apparatus that supplies a liquid under pressure from an inflow end 701 to an outflow end 702 and, at the same time, controls a flow rate of the liquid supplied under pressure by a tube pump 100.

Figure 1:
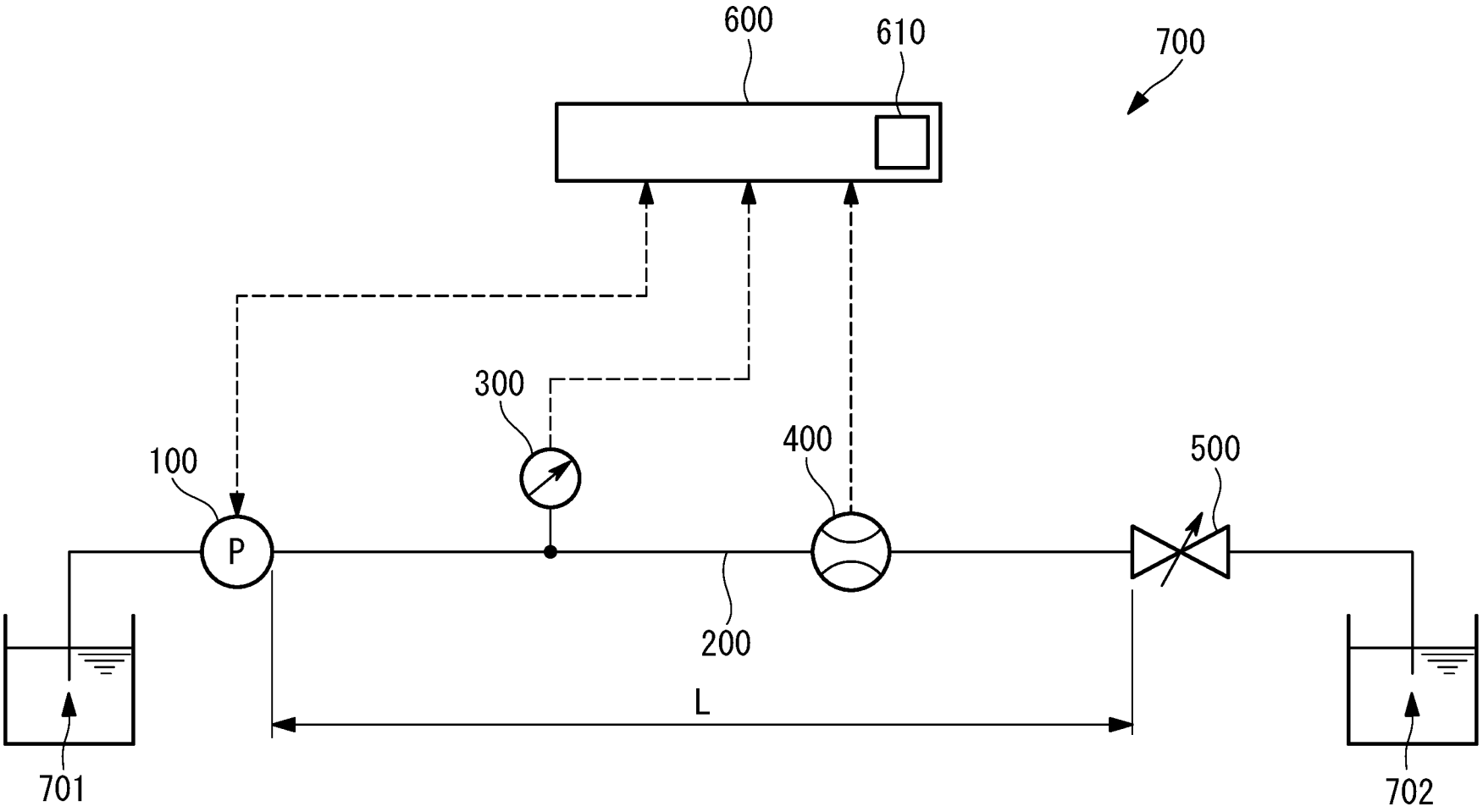
FIG. 1 is a configuration diagram showing a tube pump system according to one embodiment of the present disclosure.

As shown in FIG. 1, the tube pump system 700 of this embodiment includes: the tube pump (peristaltic pump) 100 that supplies a liquid under pressure; a pipe 200 through which the liquid is conveyed from the tube pump 100 to a needle valve 500; a pressure sensor (pressure detection unit) 300 that detects a pressure of the liquid flowing through the pipe 200; a flowmeter 400 that measures a flow rate of the liquid flowing through the pipe 200; a needle valve 500 that adjusts a pressure of the liquid flowing through the pipe 200 arranged on the upstream side of the needle valve 500; and a control unit 600 that controls a discharge amount of the liquid discharged from the tube pump 100.

Hereinafter, respective configurations of the tube pump system 700 of this embodiment are explained.

The tube pump 100 is a device that supplies a liquid under pressure from the inflow end 701 to the outflow end 702. The tube pump 100 supplies the liquid under pressure by repeating an operation where rollers are moved in a state where a tube having flexibility is compressed by the rollers. The liquid discharged from the tube pump 100 to the pipe 200 passes through the flowmeter 400 and the needle valve 500, and reaches the outflow end 702. The tube pump 100 will be mentioned later in detail.

The pipe 200 is a pipe through which a liquid is conveyed from the tube pump 100 to the needle valve 500. The pipe 200 is made of a material (for example, a resin material such as a silicone rubber) having flexibility that is elastically deformed due to a pressure of the liquid supplied under pressure by the tube pump 100. The pipe 200 can maintain a pressure of the liquid flowing through the inside of the pipe 200 at a predetermined pressure which is higher than an atmospheric pressure by adjusting an opening degree of the needle valve 500 mentioned later. A flow path length L of the pipe 200 is desirably set to approximately 1000 mm, for example.

The pressure sensor 300 is a device that detects a pressure of the liquid flowing through the inside of the pipe 200. The pressure sensor 300 is arranged on the pipe 200 through which the liquid is introduced from the tube pump 100 to the needle valve 500, at a position on the upstream side of the flowmeter 400. The pressure sensor 300 transmits the detected pressure to the control unit 600.

The flowmeter 400 is a device that measures a flow rate of the liquid flowing through the inside of the pipe 200. The flowmeter 400 is arranged on the pipe 200 through which the liquid is introduced from the tube pump 100 to the needle valve 500 at a position on the downstream side of the pressure sensor 300. The flowmeter 400 transmits the measured flow rate to the control unit 600.

The needle valve 500 is a device that adjusts a pressure of the liquid flowing through the inside of the pipe 200 such that the pressure of the liquid becomes higher than an atmospheric pressure by adjusting an insertion amount of a needle-shaped valve body (illustration is omitted) with respect to a valve hole (illustration is omitted). The needle valve 500 forms a region having a minimum flow path cross sectional area in a path through which the liquid is introduced from the tube pump 100 to the outflow end 702.

The needle valve 500 is made to have a minimum flow path cross sectional area in order to allow the needle valve 500 to have a highest pipe resistance in the path through which the liquid is introduced from the tube pump 100 to the outflow end 702. Therefore, the liquid in the pipe 200 on the upstream side of the needle valve 500 is maintained at a high static pressure. In this embodiment, the opening degree of the needle valve 500 is adjusted such that a pressure of a liquid flowing through the inside of the pipe 200 becomes higher than an atmospheric pressure.

In this embodiment, the first predetermined pressure Pr1 is desirably set to a value which falls within a range of equal to or more than 20 kPaG and equal to or less than 250 kPaG. Particularly, the first predetermined pressure Pr1 is desirably set to a value which falls within a range of equal to or more than 90 kPaG and equal to or less than 110 kPaG. Reference character "G" denotes a gauge pressure.

The pipe 200, where a liquid is maintained in the inside of the pipe 200 with a high static pressure, is made of a flexible resin material. This is because when a static pressure in the pipe 200 is further increased by pulsation of the liquid, the pipe 200 is elastically deformed and hence, transmission of pulsation of the liquid to the downstream side can be suppressed.

As described above, in the path through which a liquid is introduced from the tube pump 100 to the outflow end 702, the pipe 200 made of a flexible resin material is arranged on the upstream side of the needle valve 500 having the highest pipe resistance and hence, pulsation of the liquid supplied under pressure from the tube pump 100 can be suppressed.

The control unit 600 is a device that controls each of a first drive unit 50 and a second drive unit 60 to be mentioned later such that a liquid which flows into a flexible tube 101 of the tube pump 100 from one end of the tube 101 is discharged from the other end of the tube 101. The control unit 600 controls each of the first drive unit 50 and the second drive unit 60 such that a flow rate measured by the flowmeter 400 conforms to a predetermined target flow rate. A method for controlling the first drive unit 50 and the second drive unit 60 by the control unit 600 will be mentioned later in detail.

As shown in FIG. 1, the control unit 600 includes a memory unit 610. The memory unit 610 stores a program performed by the control unit 600. The control unit 600 reads and performs the program stored in the memory unit 610, thus performing respective processes mentioned later. The memory unit 610 is formed of a nonvolatile memory capable of rewriting data, for example. As will be mentioned later, the control unit 600 adjusts a control waveform for controlling the first drive unit 50 and the second drive unit 60, and stores the adjusted control waveform in the memory unit 610. The control unit 600 reads the control waveform stored in the memory unit 610 so that the control unit 600 can control the first drive unit 50 and the second drive unit 60 using the adjusted control waveform.

Next, the tube pump 100 of the tube pump system 700 will be explained.

Figure 2:
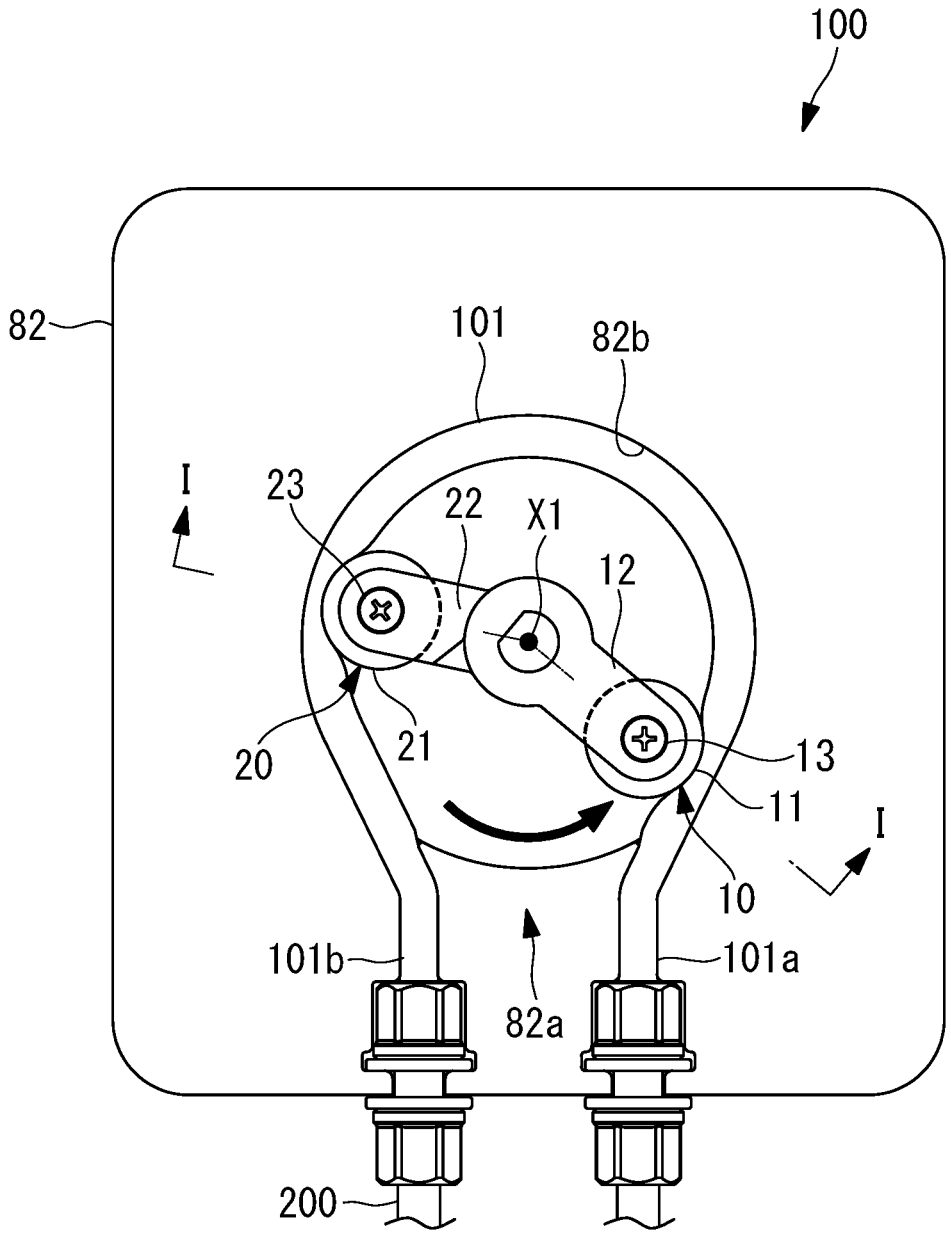
FIG. 2 is a front view of a tube pump shown in FIG. 1.

The tube pump 100 of this embodiment shown in FIG. 2 is a device where a first roller unit 10 (first contact member) and a second roller unit 20 (second contact member) are rotated around an axis line X1 (first axis line) in the same direction so as to make a fluid in a tube 101 which flows into the tube 101 discharge from an inflow-side end portion 101*a* to an outflow-side end portion 101*b*. The pipe 200 is connected to the outflow-side end portion 101*b*. FIG. 2 shows the tube pump 100 in a state where a cover 83 shown in FIG. 3 is removed.

As shown in FIG. 2 which is a front view, in the tube pump 100, the tube 101 is arranged in a circular-arc shape around the axis line X1 along an inner peripheral surface 82*b* of a recess 82*a* of a roller housing unit 82 that houses the first roller unit 10 and the second roller unit 20. As shown in FIG. 2, the first roller unit 10 and the second roller unit 20 housed in the roller housing unit 82 are rotated around the axis line X1 along a counter-clockwise rotation direction (a direction shown by an arrow in FIG. 2) while being in contact with the tube 101.

Figure 3:
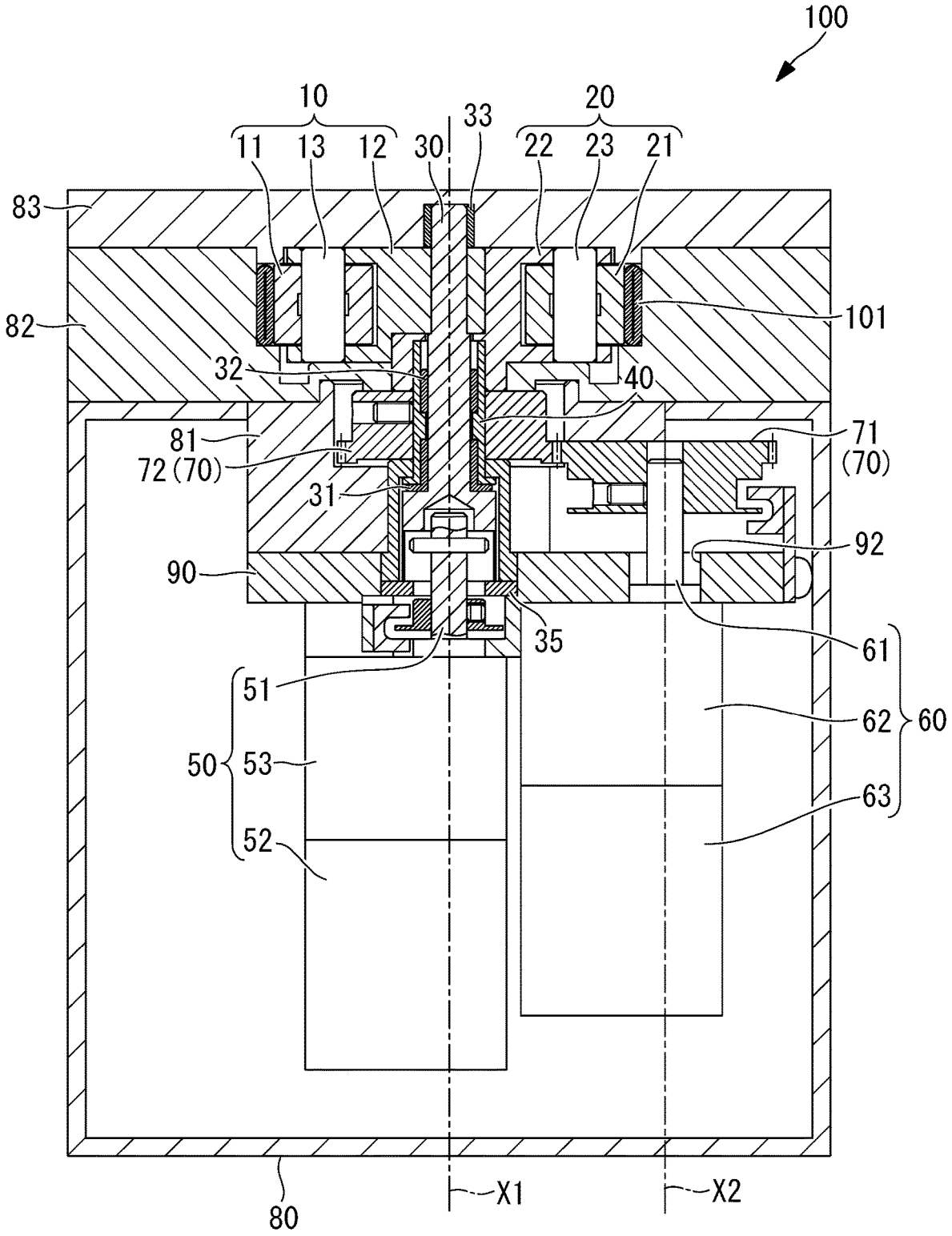
FIG. 3 is a longitudinal cross-sectional view of the tube pump shown in FIG. 2 taken along a line I-I.
Figure 4:
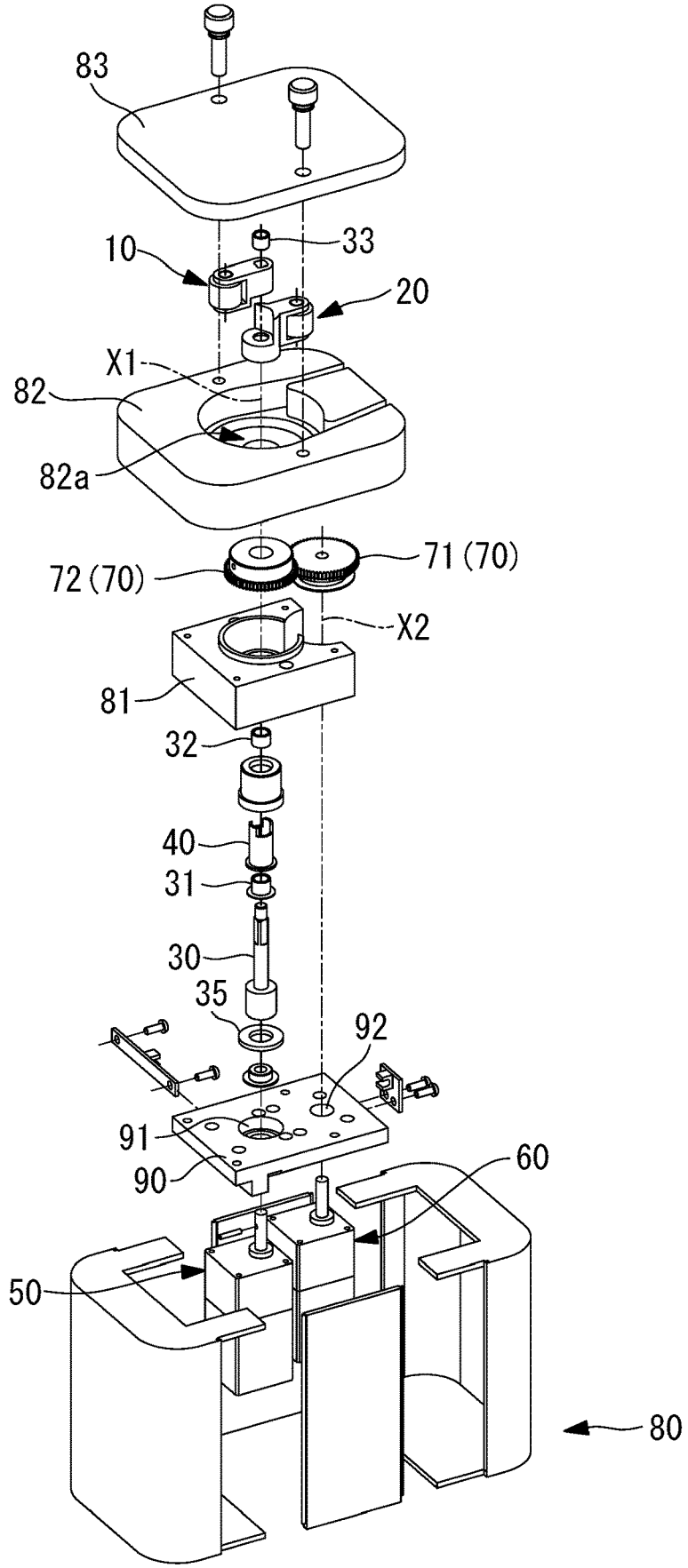
FIG. 4 is an exploded perspective view of the tube pump shown in FIG. 3.

As shown in a longitudinal cross-sectional view of FIG. 3 and an exploded perspective view of FIG. 4, the tube pump 100 of the embodiment includes: the first roller unit 10 and the second roller unit 20 that rotate around the axis X1 while being in contact with the tube 101; a drive shaft 30 (a shaft member) that is arranged on the axis X1 and is coupled to the first roller unit 10; a drive cylinder (a cylindrical member) 40 that is coupled to the second roller unit 20; a first drive unit 50 that transmits a drive force to the drive shaft 30; a second drive unit 60; and a transmission mechanism 70 (a transmission unit) that transmits a drive force of the second drive unit 60 to the drive cylinder 40.

The first roller unit 10 has: a first roller 11 that rotates around an axis parallel to the axis X1 while being in contact with the tube 101; a first roller support member 12 coupled to the drive shaft 30 so as to integrally rotate around the axis X1; and a first roller shaft 13 both ends of which are supported by the first roller support member 12, and to which the first roller 11 is rotatably attached.

The second roller unit 20 has: a second roller 21 that rotates around an axis parallel to the axis X1 while being in contact with the tube 101; a second roller support member 22 coupled to the drive cylinder 40 so as to integrally rotate around the axis X1; and a second roller shaft 23 both ends of which are supported by the second roller support member 22, and to which the second roller 21 is rotatably attached.

As shown in FIG. 3, the first drive unit 50 and the second drive unit 60 are housed inside a casing (a housing member) 80. A gear housing unit 81 for housing the transmission mechanism 70, and a support member 90 that supports the first drive unit 50 and the second drive unit 60 are attached to an inside of the casing 80. In addition, the roller housing unit 82 for housing the first roller unit 10 and the second roller unit 20 is attached to an upper part of the casing 80.

The roller housing unit 82 has the recess 82*a* that houses the first roller unit 10 and the second roller unit 20. The recess 82*a* has the inner peripheral surface 82*b* formed into a circular-arc shape around the axis line X1. As shown in FIG. 3, the tube 101 is arranged in a circular-arc shape around the axis line X1 along the inner peripheral surface 82*b*.

A first through hole 91 that extends along the axis X1 and a second through hole 92 that extends along an axis X2 are formed in the support member 90. The first drive unit 50 is attached to the support member 90 by a fastening bolt (illustration is omitted) in a state where a first drive shaft 51 is inserted into the first through hole 91 formed in the support member 90. Similarly, the second drive unit 60 is attached to the support member 90 by a fastening bolt (illustration is omitted) in a state where a second drive shaft 61 is inserted into the second through hole 92 formed in the support member 90. As described above, each of the first drive unit 50 and the second drive unit 60 is attached to the support member 90, which is the integrally formed member.

Figure 5:
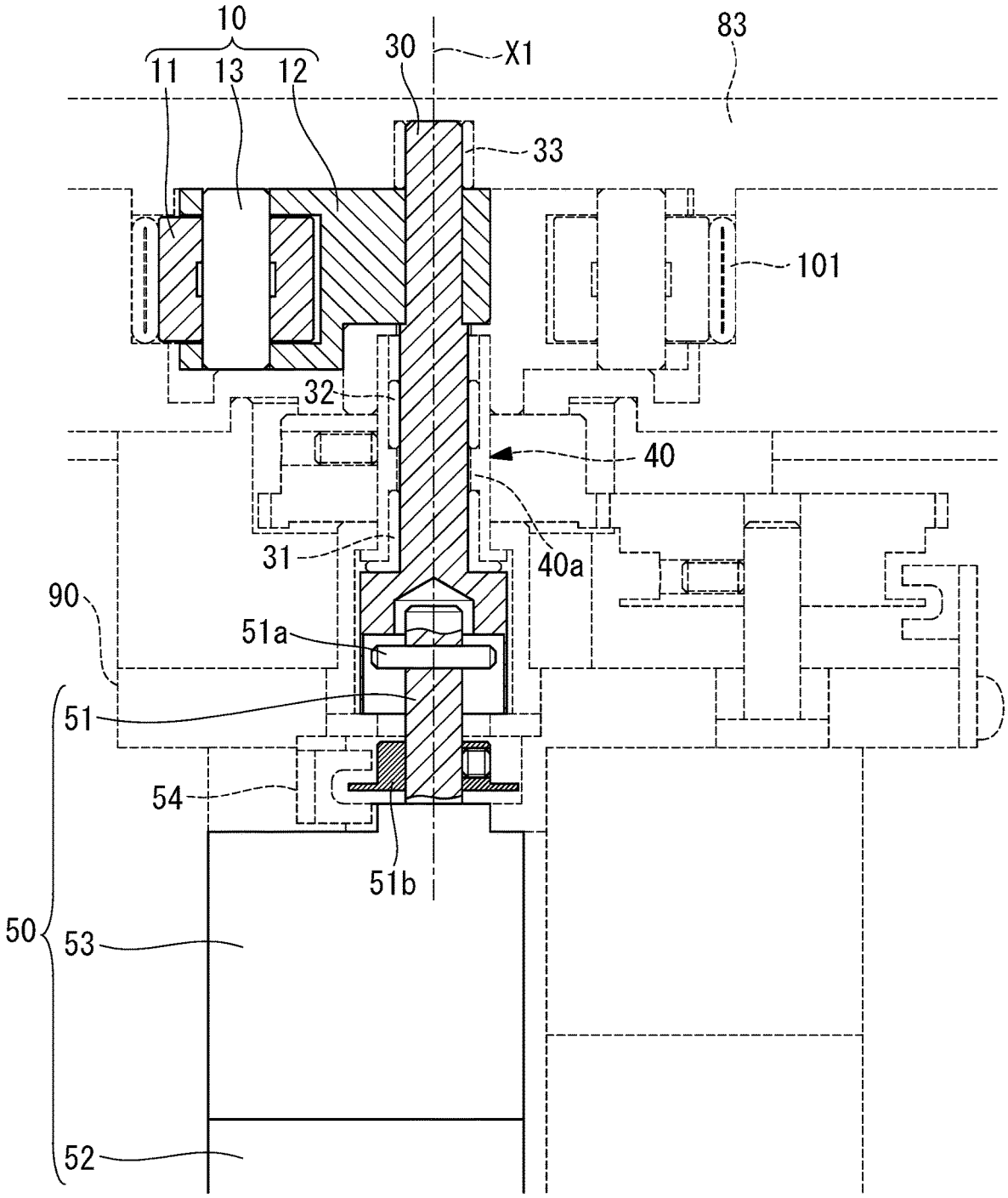
FIG. 5 is a longitudinal cross-sectional view showing a structure in which a first drive unit shown in FIG. 3 transmits a driving force to a first roller unit.

Here, with reference to FIG. 5, there will be explained a structure in which the first drive unit 50 transmits a drive force to the first roller unit 10. In FIG. 5, a portion shown by continuous lines is the portion included in the structure of transmitting a drive force of the first drive unit 50 to the first roller unit 10.

As shown in FIG. 5, the first drive unit 50 has the first drive shaft 51 that is arranged on the axis X1 and is coupled to the drive shaft 30. The first drive shaft 51 is attached to a lower end of the drive shaft 30 in a state where a pin 51*a* that extends in a direction perpendicular to the axis X1 is inserted into the first drive shaft 51. The drive shaft 30 is fixed to the first drive shaft 51 by the pin 51*a* so as not to relatively rotate around the axis X1. Therefore, when the first drive unit 50 rotates the first drive shaft 51 around the axis X1, a drive force of the first drive shaft 51 is transmitted to the drive shaft 30, and the drive shaft 30 rotates around the axis X1.

The first drive unit 50 has; the first drive shaft 51; the first electric motor 52; and a first reducer 53 that reduces a velocity of rotation of a rotation shaft (illustration is omitted) rotated by the first electric motor 52, and transmits the rotation to the first drive shaft 51. The first drive unit 50 rotates the first drive shaft 51 around the axis X1 by transmitting a drive force of the first electric motor 52 to the first drive shaft 51.

A position detecting member 51*b* that rotates around the axis X1 together with the first drive shaft 51 is attached to the first drive shaft 51. In the position detecting member 51*b*, in an annularly formed outer peripheral edge, a slit (illustration is omitted) for detecting a rotation position of the first roller unit 10 around the axis X1 is formed in a peripheral direction around the axis X1.

As shown in FIG. 5, a position detection sensor 54 is arranged so as to sandwich an upper surface and a lower surface of the outer peripheral edge of the position detecting member 51*b*. The position detection sensor 54 is the sensor in which a light-emitting element is arranged on one of an upper surface side and a lower surface side, and in which a light-receiving element is arranged on the other of the upper surface side and the lower surface side. The position detection sensor 54 detects a rotation position indicating which position the first roller unit 10 is arranged around the axis X1 by detecting by the light-receiving element through the slit that light emitted by the light-emitting element passes through in connection with the rotation of the position detecting member 51*b* around the axis X1, and transmits it to a control unit 600.

The lower end of the drive shaft 30 is coupled to the first drive shaft 51, and an upper end thereof is inserted into an insertion hole formed in the cover 83. A third bearing member 33 that rotatably supports a tip of the first drive shaft 51 around the axis X1 is inserted into the insertion hole of the cover 83. In addition, the drive shaft 30 is rotatably supported around the axis X1 on an inner peripheral side of the drive cylinder 40 by a cylindrical first bearing member 31 inserted along the outer peripheral surface, and a cylindrical second bearing member 32 formed independently from the first bearing member 31.

As described above, in the drive shaft 30, the outer peripheral surface of a lower end side is supported by the first bearing member 31, the outer peripheral surface of a central portion is supported by the second bearing member 32, and the outer peripheral surface of a tip side is supported by the third bearing member 33. Therefore, the drive shaft 30 smoothly rotates around the axis X1 in a state of holding a central axis on the axis X1.

Here, a reason why the first bearing member 31 and the second bearing member 32 are arranged in the axis X1 direction in a state of being separated from each other as shown in FIG. 5 is that an endless annular projection part 40*a* that extends around the axis X1 is formed at an inner peripheral surface of the drive cylinder 40.

The first roller support member 12 of the first roller unit 10 is coupled to the tip side of the drive shaft 30 so as to integrally rotate around the axis X1. As described above, the drive force by which the first drive unit 50 rotates the first drive shaft 51 around the axis X1 is transmitted from the first drive shaft 51 to the first roller unit 10 through the drive shaft 30.

Figure 6:
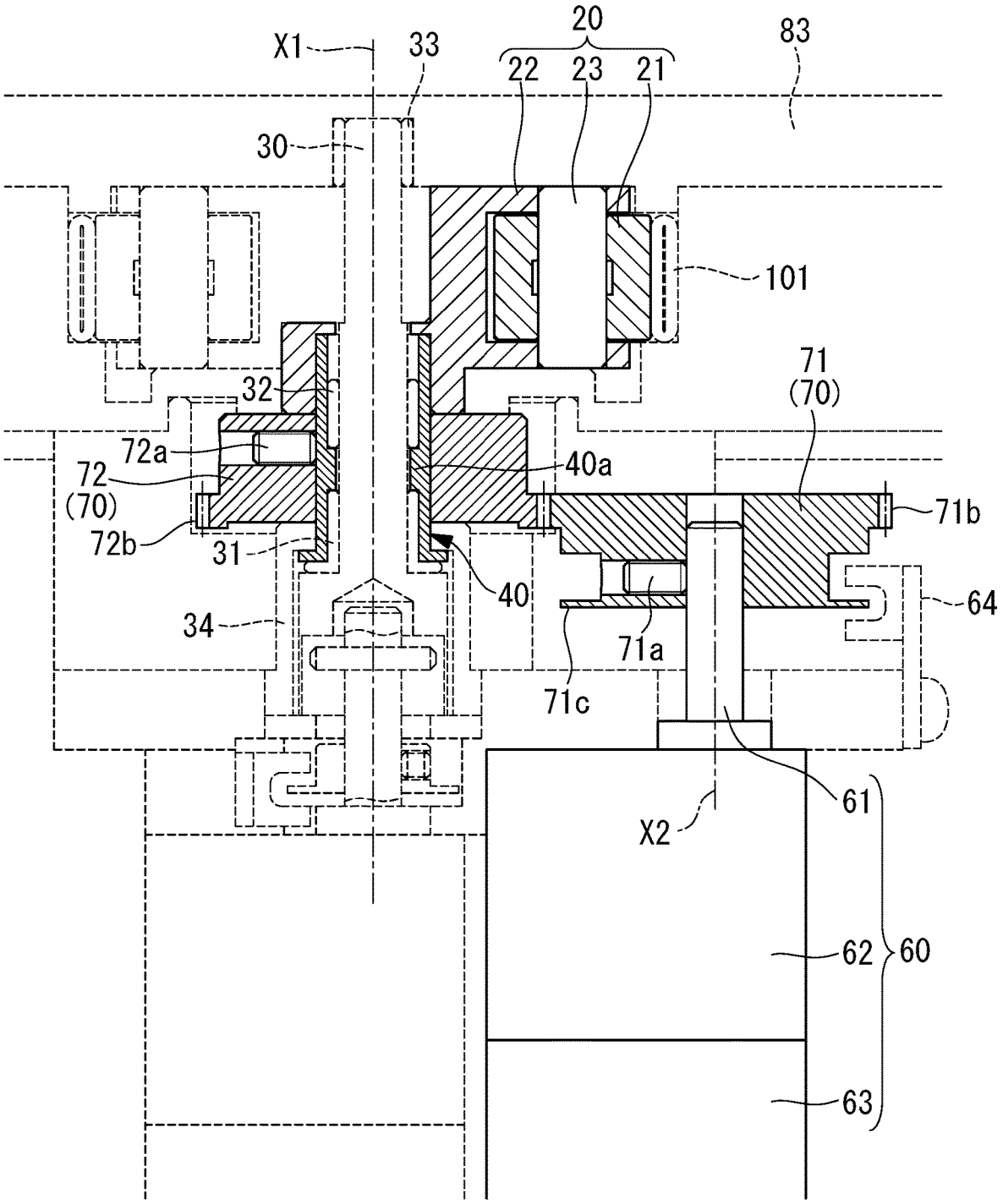
FIG. 6 is a longitudinal cross-sectional view showing a structure in which a second drive unit shown in FIG. 3 transmits a driving force to a second roller unit.

Next, with reference to FIG. 6, there will be explained a structure in which the second drive unit 60 transmits a drive force to the first roller unit 10. In FIG. 6, a portion shown by continuous lines is the portion included in the structure of transmitting the drive force of the second drive unit 60 to the second roller unit 20. The structure shown in FIG. 6 has: the second roller unit 20; the drive cylinder 40; the second drive unit 60; and the transmission mechanism 70.

The transmission mechanism 70 shown in FIG. 6 has: a first gear unit 71 that rotates around the axis X2 (a second axis) parallel to the axis X1; and a second gear unit 72 to which a drive force of the second drive shaft 61 is transmitted from the first gear unit 71. The transmission mechanism 70 transmits the drive force of the second drive shaft 61 around the axis X2 to the outer peripheral surface of the drive cylinder 40, and rotates the drive cylinder 40 around the axis X1.

As shown in FIG. 6, the second drive unit 60 has; the second drive shaft 61 arranged on the axis X2; a second electric motor 62; and a second reducer 63 that reduces a velocity of rotation of a rotation shaft (illustration is omitted) rotated by the second electric motor 62, and transmits the rotation to the second drive shaft 61. The second drive unit 60 rotates the second drive shaft 61 around the axis X2 by transmitting a drive force of the second electric motor 62 to the second drive shaft 61.

The second drive shaft 61 is inserted into an insertion hole formed in a central portion of the first gear unit 71 formed in a cylindrical shape around the axis X2. The first gear unit 71 is fixed to the second drive shaft 61 by fastening a fixing screw 71*a* in a state where the second drive shaft 61 is inserted into the first gear unit 71, and making a tip of the fixing screw 71*a* abut against the second drive shaft 61. In a manner as described above, the first gear unit 71 is coupled to the second drive shaft 61, and rotates around the axis X2 together with the second drive shaft 61.

A first gear 71*b* of the first gear unit 71 formed around the axis X2 is engaged with a second gear 72*b* of the second gear unit 72 formed around the axis X1. Therefore, a drive force by rotation of the first gear unit 71 around the axis X2 is transmitted as the drive force that rotates the second gear unit 72 around the axis X1.

A position detecting member 71*c* that rotates around the axis X1 together with the second drive shaft 61 is formed at the first gear unit 71. In the position detecting member 71*c*, in an annularly formed outer peripheral edge, a slit (illustration is omitted) for detecting a rotation position of the second roller unit 20 around the axis X1 is formed in a peripheral direction around the axis X2.

As shown in FIG. 6, a position detection sensor 64 is arranged so as to sandwich an upper surface and a lower surface of an outer peripheral edge of the position detecting member 71*c*. The position detection sensor 64 is the sensor in which a light-emitting element is arranged on one of an upper surface side and a lower surface side, and in which a light-receiving element is arranged on the other of the upper surface side and the lower surface side. The position detection sensor 64 detects a rotation position indicating which position the second roller unit 20 is arranged around the axis X1 by detecting by the light-receiving element through the slit that light emitted by the light-emitting element passes through in connection with the rotation of the position detecting member 71*c* around the axis X2, and transmits it to the control unit 600.

The drive cylinder 40 is inserted into an insertion hole formed in a central portion of the second gear unit 72 formed in a cylindrical shape around the axis X1. The insertion hole is a hole having an inner peripheral surface coupled to the outer peripheral surface of the drive cylinder 40.

The second gear unit 72 is fixed to the drive cylinder 40 by fastening a fixing screw 72*a* in a state where the drive cylinder 40 is inserted into the second gear unit 72, and making a tip of the fixing screw 72*a* abut against the drive cylinder 40. In a manner as described above, the second gear unit 72 is coupled to the drive cylinder 40, and rotates around the axis X1 together with the drive cylinder 40.

As shown in FIG. 6, the drive cylinder 40 is arranged in a state of sandwiching the first bearing member 31 and the second bearing member 32 on an outer peripheral side of the drive shaft 30. Therefore, the drive cylinder 40 can be rotated around the axis X1 independently from the drive shaft 30. The drive shaft 30 rotates around the axis X1 by the drive force by the first drive unit 50, and the drive cylinder 40 rotates around the axis X1 by the drive force by the second drive unit 60 in a state of being independent from the drive shaft 30.

The second roller support member 22 of the second roller unit 20 is coupled to a tip side of the drive cylinder 40 so as to integrally rotate around the axis X1. As described above, the drive force by which the second drive unit 60 rotates the second drive shaft 61 around the axis X2 is transmitted to the outer peripheral surface of the drive cylinder 40 by the transmission mechanism 70, and is transmitted from the drive cylinder 40 to the second roller unit 20.

Next, discharging of a liquid performed by the tube pump system 700 of this embodiment will be explained with reference to drawings.

As shown in FIG. 1, the tube pump system 700 of this embodiment detects a pressure of the liquid discharged from the tube pump 100 to the pipe 200 by the pressure sensor 300, and transmits the pressure of the liquid to the control unit 600. The tube pump system 700 also measures a flow rate of the liquid flowing through the pipe 200 by the flowmeter, and transmits the flow rate of the liquid to the control unit 600. The control unit 600 controls angular velocities of the first roller unit 10 and the second roller unit 20 around the axis line X1 such that the flow rate of the liquid flowing through the pipe 200 agrees with a target flow rate.

In the tube pump system 700 shown in FIG. 1, a control signal for controlling the first drive unit 50 and the second drive unit 60 of the tube pump 100 is transmitted from the control unit 600 to the tube pump 100.

The tube pump 100 may be formed as a device in which the control unit 600 is incorporated. In this case, the control unit 600 incorporated in the tube pump 100 generates a control signal for controlling the first drive unit 50 and the second drive unit 60, and transmits the control signal to the first drive unit 50 and the second drive unit 60.

Figure 7:
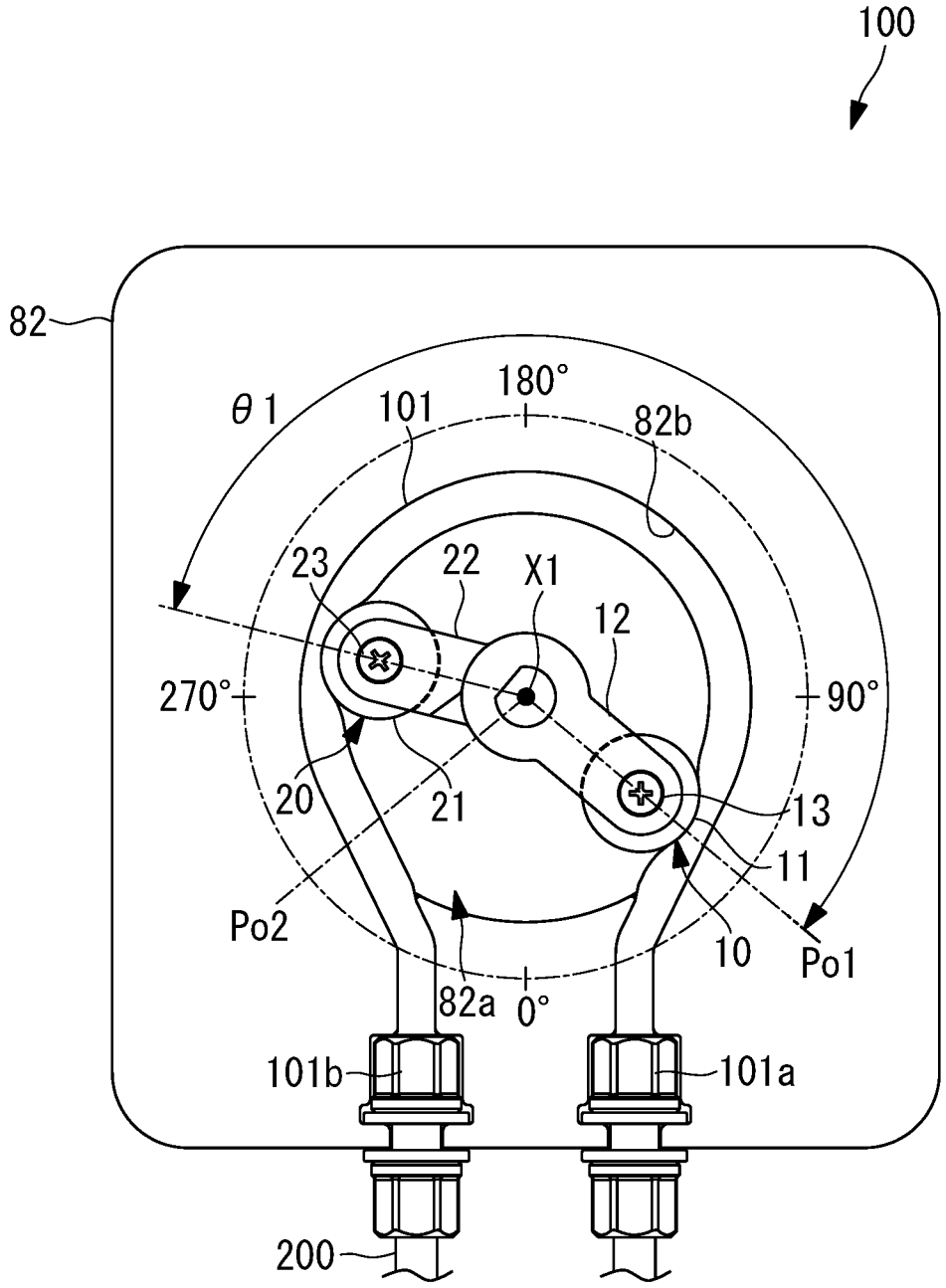
FIG. 7 is a front view showing the tube pump in a state where the first roller unit reaches a closing position.
Figure 8:
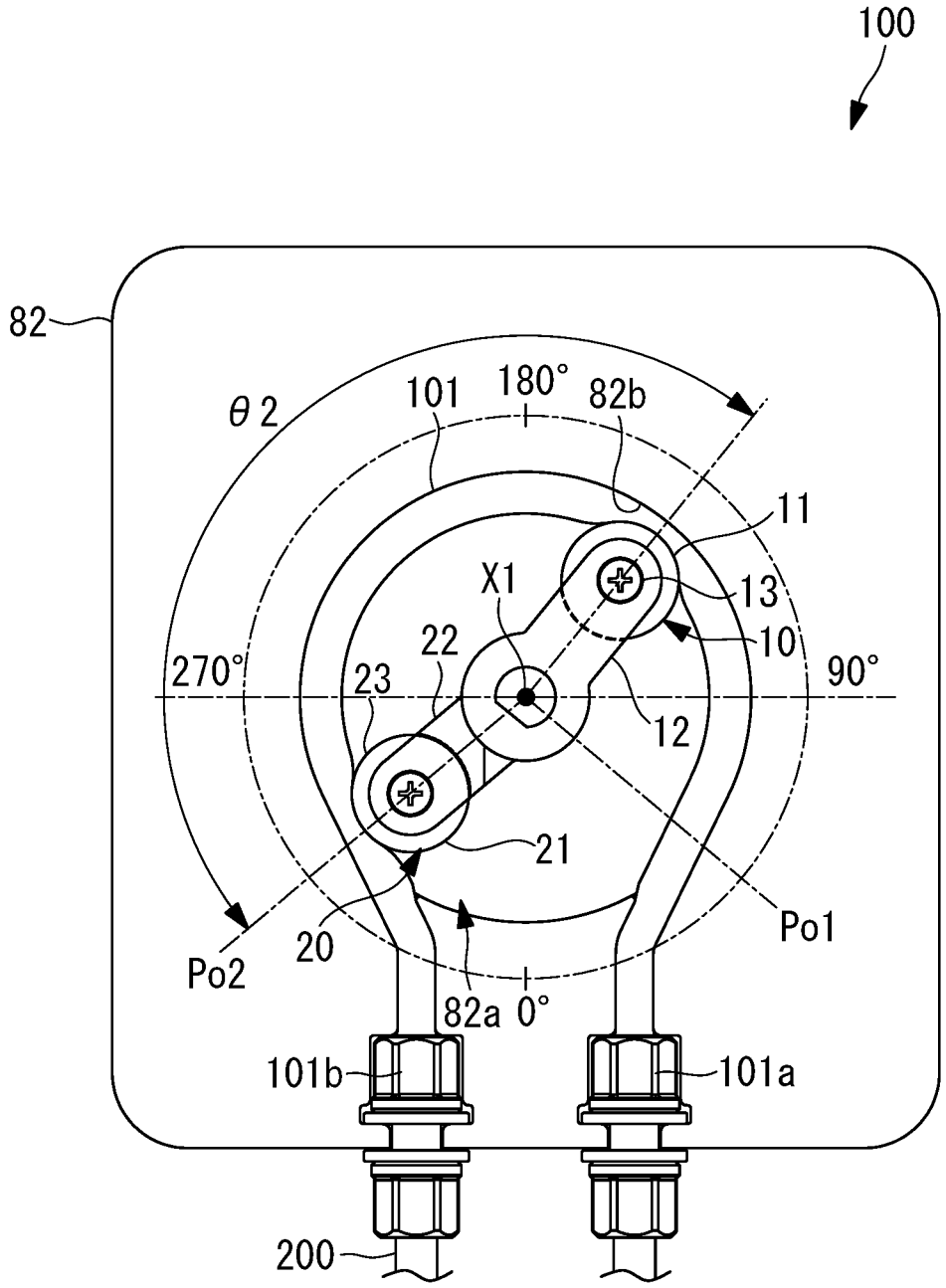
FIG. 8 is a front view showing the tube pump in a state where the second roller unit reaches a releasing position.

FIG. 7 is a front view showing the tube pump 100 in a state where the first roller unit 10 reaches a closing position Po1. FIG. 8 is a front view showing the tube pump 100 in a state where the second roller unit 20 reaches a releasing position Po2. The closing position Po1 indicates a position around the axis line X1 at which a state of the first roller unit 10 or the second roller unit 20 changes over from a state of not closing the tube 101 to a state of closing the tube 101. Further, the releasing position Po2 indicates a position around the axis line X1 at which a state where the first roller unit 10 or the second roller unit 20 closes the tube 101 is released so that a state of the first roller unit 10 or the second roller unit 20 changes over to a state of not closing the tube 101. Each of the first roller unit 10 and the second roller unit 20 is independently rotated around the axis line X1 in a state where the first roller unit 10 or the second roller unit 20 closes the tube 101 in cooperation with the inner peripheral surface 82*b* from the closing position Po1 to the releasing position Po2.

0°, 90°, 180° and 270° shown in FIG. 7 indicate rotation angles around the axis line X1, and indicate angles in the counterclockwise direction with the position of 0° as a reference. The closing position Po1 is at a rotation angle of 50°, for example. The releasing position Po2 is at a rotation angle of 310°, for example.

The first rotation angle θ1 shown in FIG. 7 is a rotation angle around the axis line X1 formed between the first roller unit 10 and the second roller unit 20 when the first roller unit 10 passes through the closing position Po1. A second rotation angle θ2 shown in FIG. 8 is a rotation angle around the axis line X1 formed between the first roller unit 10 and the second roller unit 20 when the second roller unit 20 passes through the releasing position Po2.

Figure 9:
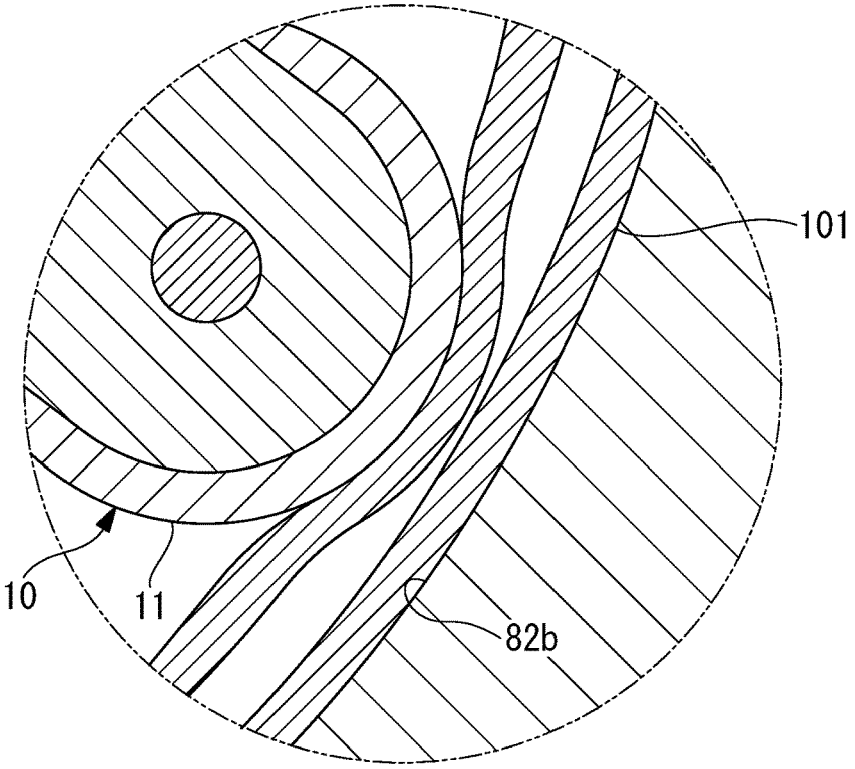
FIG. 9 is a cross-sectional view of an area in the vicinity of the first roller unit of the tube pump shown in FIG. 7.

FIG. 9 is a cross-sectional view of an area in the vicinity of the first roller unit 10 of the tube pump 100 shown in FIG. 7. As shown in FIG. 9, when the first roller unit 10 reaches the closing position Po1, a state of the tube 101 changes over from a state of not being closed to a state of being closed. At this point of operation, a flow path cross sectional area of the tube 101 changes over to zero from a value larger than zero.

Figure 10:
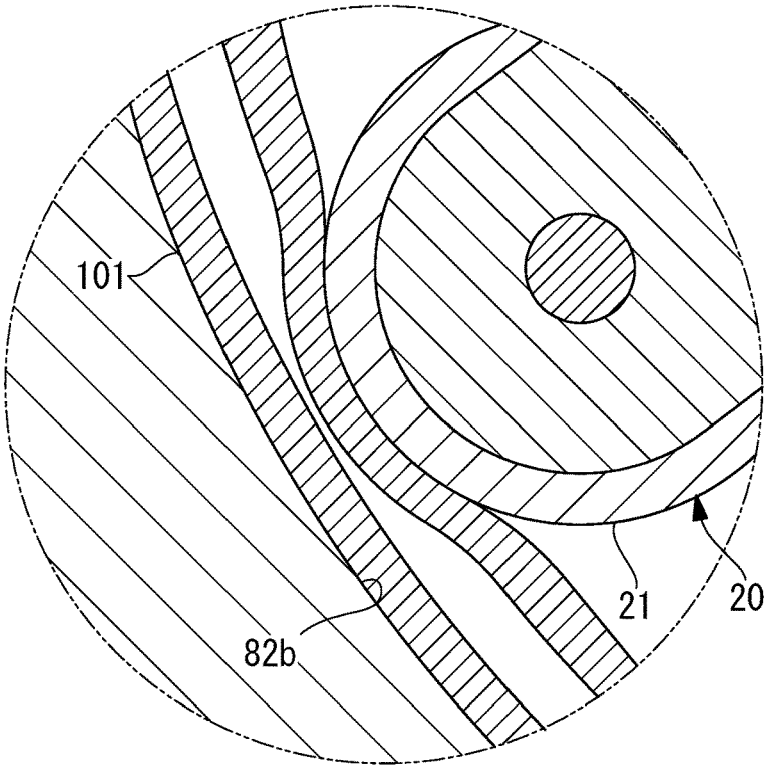
FIG. 10 is a cross-sectional view of an area in the vicinity of the second roller unit of the tube pump shown in FIG. 8.

FIG. 10 is a cross-sectional view of an area in the vicinity of the second roller unit 20 of the tube pump 100 shown in FIG. 9. As shown in FIG. 10, when the second roller unit 20 reaches the releasing position Po2, a state of the tube 101 changes over from a state of being closed to a state of not being closed. At this point of operation, a flow path cross sectional area of the tube 101 changes over to a value larger than zero from zero.

Figure 11:
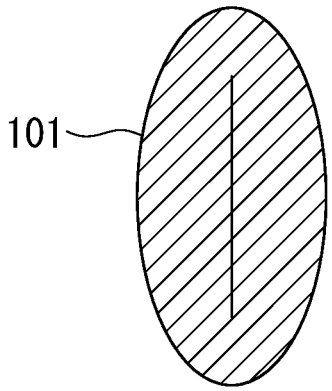
FIG. 11 is a transverse cross-sectional view showing a tube closed by the roller unit.
Figure 12:
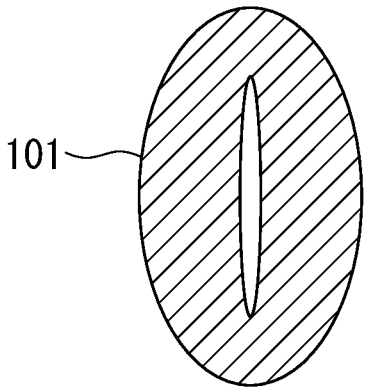
FIG. 12 is a transverse cross-sectional view showing the tube where a closed state brought about by the roller unit is released.

FIG. 11 is a transverse cross-sectional view showing the tube 101 in a state of being closed by the first roller unit 10 or the second roller unit 20. FIG. 12 is a transverse cross-sectional view showing the tube 101 where a closed state brought about by the first roller unit 10 or the second roller unit 20 is released. The flow path cross sectional area of the tube 101 shown in FIG. 11 is zero, whereas the flow path cross sectional area of the tube 101 shown in FIG. 12 is a value larger than zero.

Figure 13:
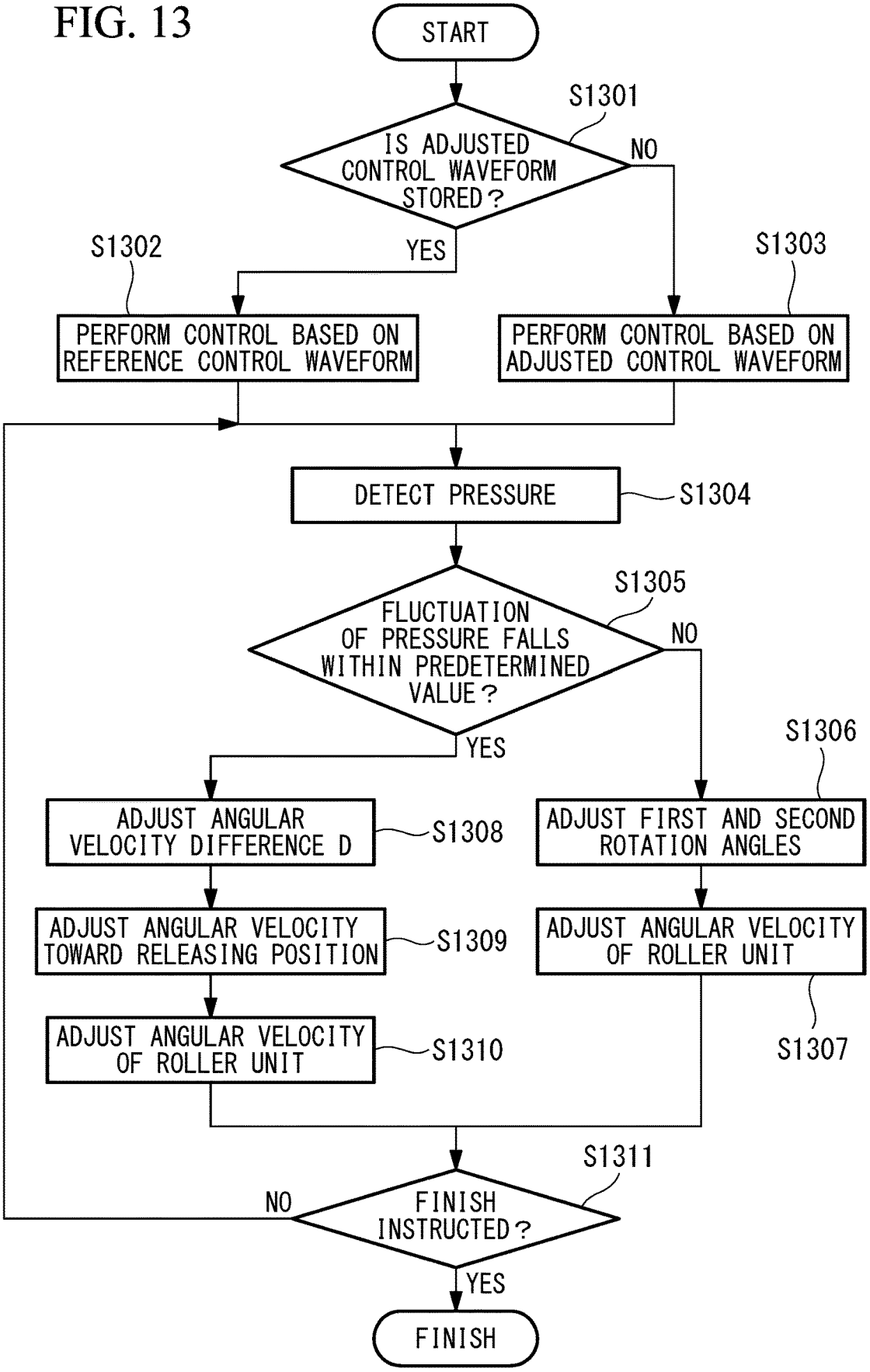
FIG. 13 is a flowchart showing a process performed by a control unit.

Next, a process performed by the control unit 600 will be described. FIG. 13 is a flowchart showing the process performed by the control unit 600. The control unit 600 performs a control such that the flow rate of a liquid which flows through the pipe 200 agrees with the target flow rate. The control unit 600 also performs a control such that even when the pulsation state dynamically varies, the pulsation is appropriately suppressed in correspondence with such variation.

When power is supplied, or when a target flow rate Ft [ml/min] is set and the start of control is instructed by an operator, the control unit 600 starts the respective processes shown in FIG. 13. The control unit 600 controls the first drive unit 50 and the second drive unit 60 such that the flow rate of a liquid measured by the flowmeter 400 agrees with the target flow rate Ft [ml/min].

In step S1301, the control unit 600 determines whether or not a control waveform adjusted in the respective processes mentioned later is stored in the memory unit 610. When the determination is YES, the control unit 600 advances the process to step S1302. When the determination is NO, the control unit 600 advances the process to step S1303. The control unit 600 controls the first drive unit 50 and the second drive unit 60 based on the control waveform such that the first roller unit 10 and the second roller unit 20 are rotated with a correspondence between the rotation angle and the angular velocity shown by the control waveform.

In step S1302, the control unit 600 controls the first drive unit 50 and the second drive unit 60 based on the reference control waveform, thus controlling angular velocity of the first roller unit 10 and the second roller unit 20 at each rotation angle.

In step S1303, the control unit 600 reads the adjusted control waveform from the memory unit 610, and controls the first drive unit 50 and the second drive unit 60 based on the adjusted control waveform. A method for adjusting a control waveform will be mentioned later.

Figure 14:
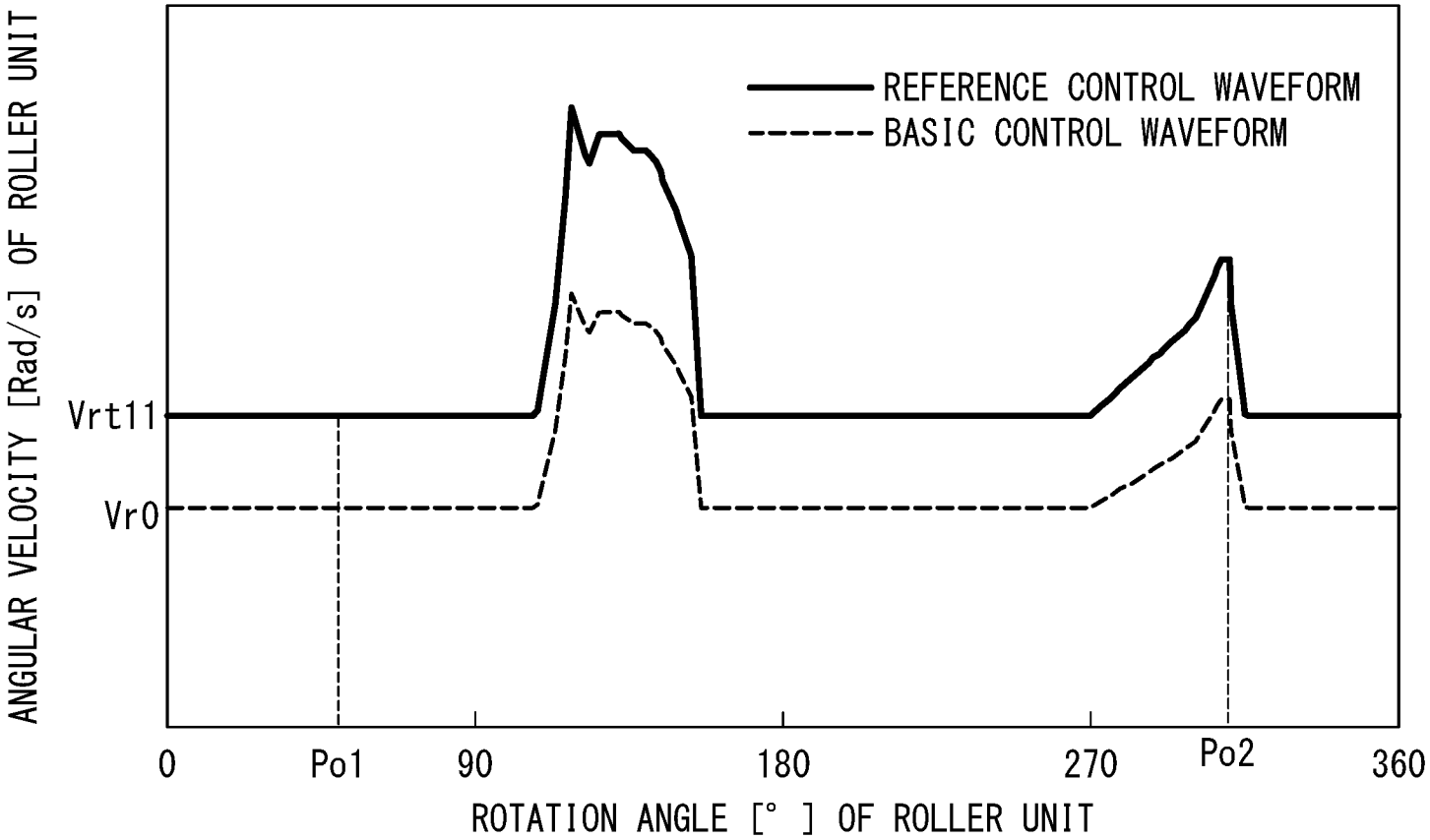
FIG. 14 is a graph showing a correspondence between a rotation angle of the roller unit and an angular velocity of the roller unit.

FIG. 14 is a graph showing a correspondence between a rotation angle of the roller unit (the first roller unit 10 and the second roller unit 20) and an angular velocity of the roller unit. A solid line in FIG. 14 indicates a reference control waveform, and a broken line in FIG. 14 indicates a basic control waveform. Numerical values of the rotation angle taken on an axis of abscissas in FIG. 14 correspond to numerical values of the rotation angles shown in FIG. 7 and FIG. 8. The first roller unit 10 and the second roller unit 20 are respectively disposed at different rotation angles, but have the same angular velocity at each rotation angle.

The basic control waveform is stored in advance in the memory unit 610. For example, the basic control waveform is a control waveform which generates almost no pulsation in a liquid discharged to the pipe 200 in a state where the pressure sensor 300 detects 0 kPaG. The basic control waveform is formed by being adjusted in advance by the manufacturer when the tube pump system 700 is manufactured. The basic control waveform is stored in the memory unit 610. When the rotation of the first roller unit 10 and the second roller unit 20 is controlled based on the basic control waveform, the tube pump system 700 discharges a liquid at a predetermined basic flow rate F0 [ml/min] to the pipe 200.

When the control unit 600 rotates the first roller unit 10 and the second roller unit 20 based on the basic control waveform, as shown in FIG. 14, the angular velocity of each roller unit at the rotation angle of 0° to 90° and 180° to 270° assumes Vr0. On the other hand, when the control unit 600 rotates the first roller unit 10 and the second roller unit 20 based on the reference control waveform, an angular velocity of each roller unit at the rotation angle of 0° to 90° and 180° to 270° assumes Vtr11. Vtr11 satisfies the following formula (1).

$$Vrt11 = Vr0 \cdot Ft/F0 \quad (1)$$

As shown in formula (1), Vtr11 in the reference control waveform is a value obtained by multiplying Vr0 by a ratio of the target flow rate Ft to the basic flow rate F0. The control unit 600 thus generates a reference control waveform by multiplying an angular velocity at each rotation position of the basic control waveform stored in the memory unit 610 by Ft/F0. In this embodiment, it is assumed that the basic control waveform and the basic flow rate F0 are stored in advance in the memory unit 610.

The control unit 600 calculates Ft/F0 from the target flow rate Ft, instructed by the operator, and the basic flow rate F0, stored in the memory unit 610, and then the control unit 600 multiplies the basic control waveform by Ft/F0, thus generating the reference control waveform. The control unit 600 controls the first drive unit 50 and the second drive unit 60 using the generated reference control waveform, thus causing the first roller unit 10 and the second roller unit 20 to rotate around the axis line X1.

Figure 15:
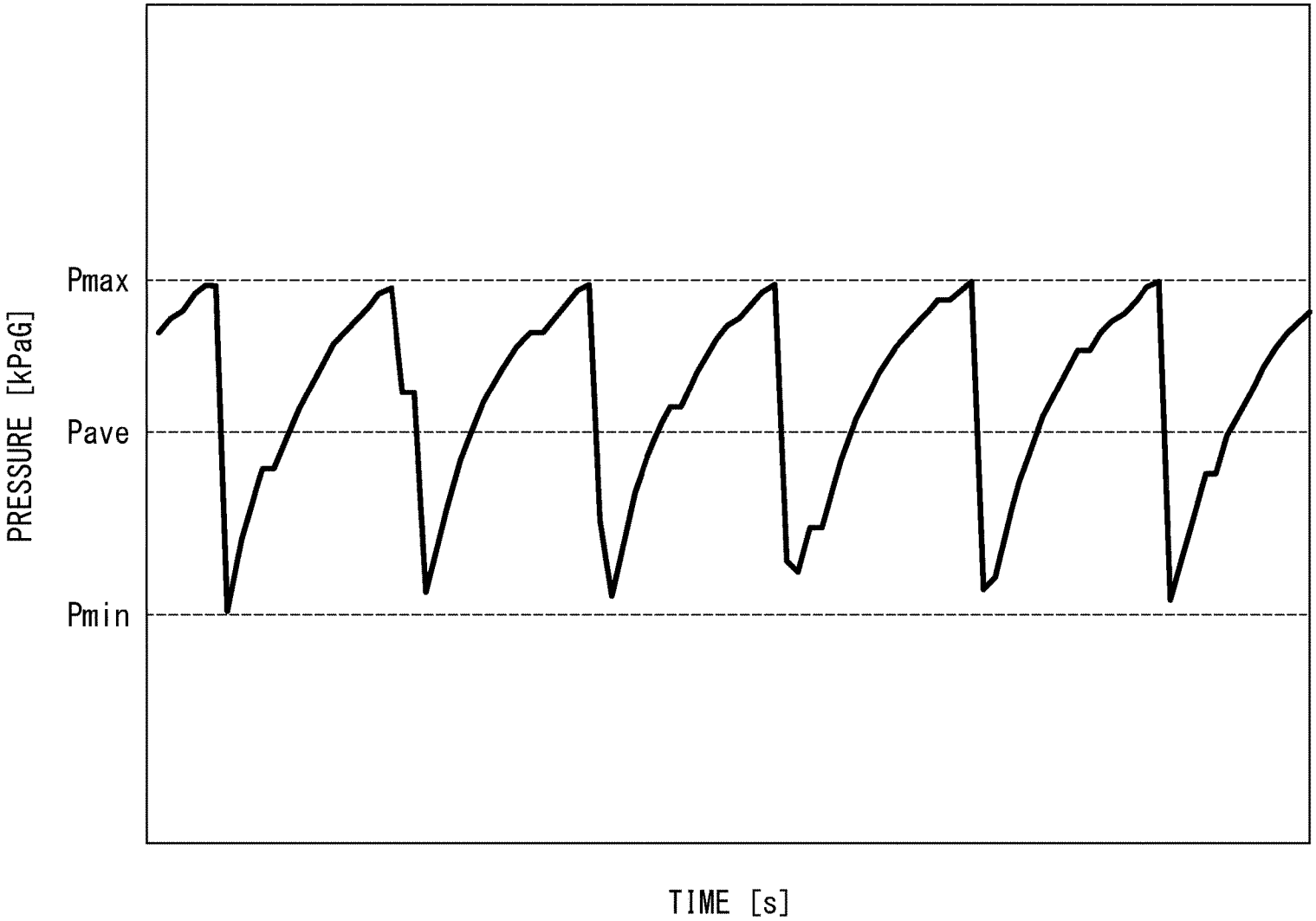
FIG. 15 is a graph showing one example of variation over time of a pressure detected by a pressure sensor when the drive unit is controlled based on a reference control waveform.

FIG. 15 is a graph showing one example of variation over time of a pressure detected by the pressure sensor 300 when the control unit 600 controls the first drive unit 50 and the second drive unit 60 based on the reference control waveform generated by the control unit 600. The example shown in FIG. 15 shows variation of pressure when the first roller unit 10 and the second roller unit 20 are rotated through three revolutions around the axis line X1. As shown in FIG. 15, a pressure detected by the pressure sensor 300 periodically fluctuates between a minimum value Pmin and a maximum value Pmax so that a fluctuation ΔP of pressure is Pmax-Pmin. Pave in FIG. 15 indicates the average value of pressure.

This periodical pressure fluctuation is generated mainly due to a pressure difference between the pressure of liquid on the downstream side of the releasing position Po2 and the pressure of liquid on the upstream side of the releasing position Po2 when one of the first roller unit 10 and the second roller unit 20 passes through the releasing position Po2 and the tube 101 compressed by the roller unit returns to the original shape. The control unit 600 adjusts the control waveform mentioned later such that a fluctuation ΔP of pressure falls within a predetermined value Pdif.

In step S1304, the control unit 600 detects the pressure of a liquid which flows through the pipe 200 using the pressure sensor 300. The control unit 600 causes the memory unit 610 to store a pressure detected by the pressure sensor 300 when the first roller unit 10 and the second roller unit 20 are rotated around the axis line X1 through at least one revolution (one revolution, three revolutions, for example).

In step S1305, the control unit 600 determines with reference to the pressure stored in the memory unit 610 whether or not the fluctuation ΔP of pressure when the first roller unit 10 and the second roller unit 20 are rotated around the axis line X1 through at least one revolution falls within the predetermined value Pdif. When the fluctuation ΔP does not fall within the predetermined value Pdif, the control unit 600 advances the process to step S1306. On the other hand, when the fluctuation ΔP falls within the predetermined value Pdif, the control unit 600 advances the process to step S1308.

In step S1306, the fluctuation ΔP of pressure is larger than the predetermined value Pdif and hence, the control unit 600 adjusts the first rotation angle θ1 shown in FIG. 7 and the second rotation angle θ2 shown in FIG. 8 so as to reduce the fluctuation ΔP of pressure. The reason for the adjustment of the first rotation angle θ1 and the second rotation angle θ2 is that a pressure difference between liquid on the downstream side of the releasing position Po2 and liquid on the upstream side of the releasing position Po2 is a value which corresponds to the first rotation angle θ1 and the second rotation angle θ2. That is, the larger a difference between the first rotation angle θ1 and the second rotation angle θ2, the higher the pressure of a liquid in the tube 101 which is closed by contact with the pair of roller units becomes. The smaller a difference between the first rotation angle θ1 and the second rotation angle θ2, the lower the pressure of a liquid in the tube 101 which is closed by contact with the pair of roller units becomes.

The control unit 600 adjusts a control waveform based on which the first drive unit 50 and the second drive unit 60 are controlled such that the second rotation angle θ2 is smaller than the first rotation angle θ1. The control waveform is adjusted as described above so as to cause a liquid which flows into the tube 101 at a pressure substantially equal to the atmospheric pressure to be discharged to the pipe 200 in a state where the pressure of the liquid is set higher than the atmospheric pressure. When the second rotation angle θ2 is set smaller than the first rotation angle θ1, the pressure of a liquid discharge to the pipe 200 is set higher than the atmospheric pressure.

Figure 16:
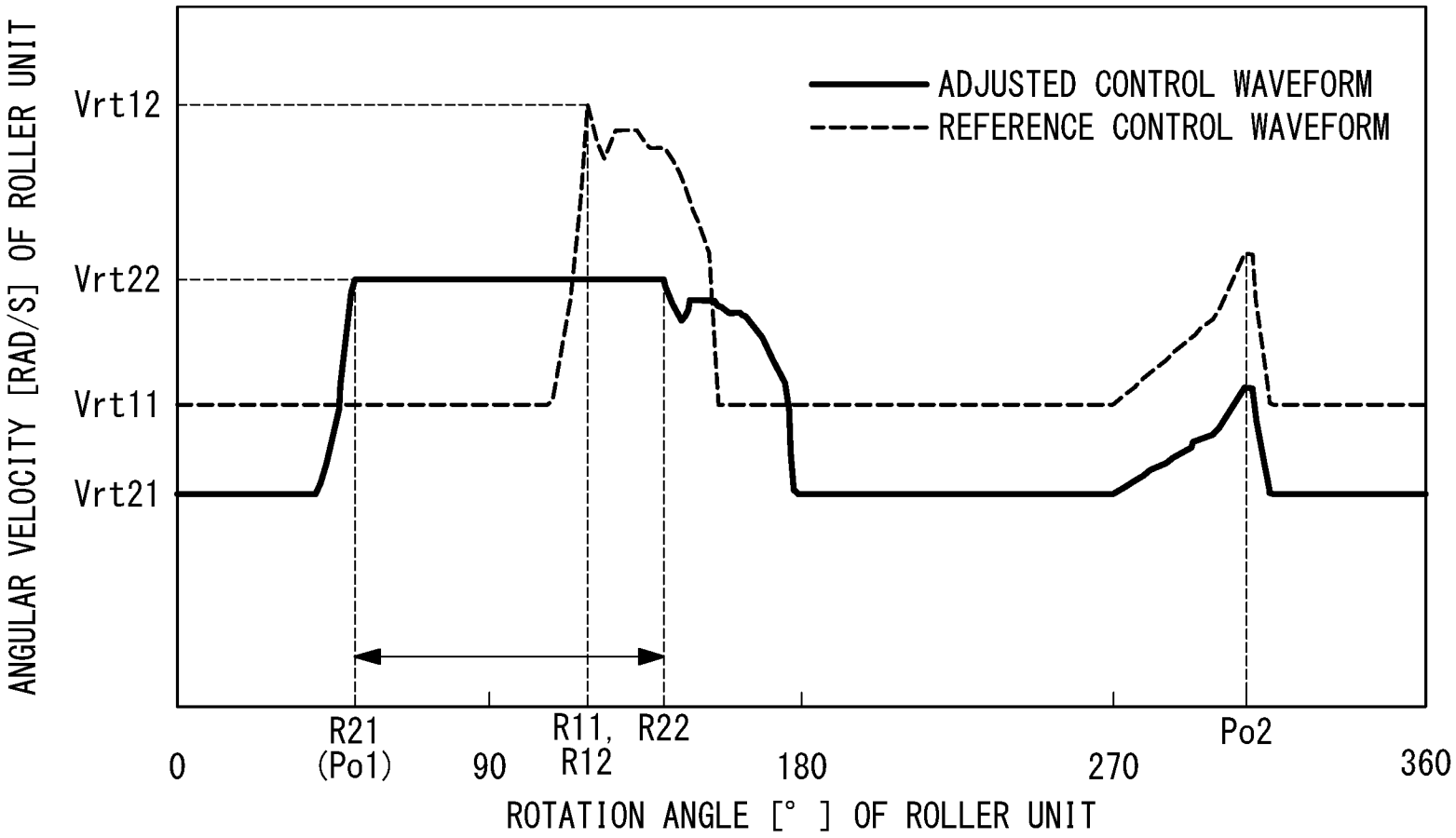
FIG. 16 is a graph showing a correspondence between a rotation angle of the roller unit and an angular velocity of the roller unit.

FIG. 16 is a graph showing a correspondence between the rotation angle of the roller unit and an angular velocity of the roller unit, and showing the reference control waveform before the first rotation angle θ1 and the second rotation angle θ2 are adjusted, and a control waveform after the first rotation angle θ1 and the second rotation angle θ2 are adjusted. Specifically, the control unit 600 changes, in the reference control waveform generated in step S1302, a rotation angle R1, at which an angular velocity reaches Vrt12 after being increased from Vtr11, to a rotation angle R21, and the control unit 600 changes a rotation angle R12, at which a decrease in an angular velocity from Vrt12 to Vtr11 starts, to a rotation angle R22. The example shown in FIG. 16 is an example where the rotation angle R11 and the rotation angle R12 are the same angle. Note that the angular velocity Vtr11 and the angular velocity Vrt12 are adjusted in the process in step S1307 mentioned later so that the angular velocity Vtr11 is set to an angular velocity Vrt21, and the angular velocity Vrt12 is set to an angular velocity Vrt22.

As shown in FIG. 16, in the range of the rotation angle before and after the roller unit passes through the releasing position Po2, the adjusted control waveform agrees with the reference control waveform. Accordingly, there is no variation of the manner of operation of the roller unit when the roller unit passes through the releasing position Po2 between the reference control waveform and the adjusted control waveform.

On the other hand, in the range of the rotation angle from the closing position Po1 to 180°, the adjusted control waveform is different from the reference control waveform. Specifically, a range of the rotation angle from the completion of an increase in angular velocity to the start of a decrease in angular velocity is increased to (R22−R21) from (R12−R11). In the example shown in FIG. 16, R12 is equal to R11 (R12=R11) so that an increase amount of the range of the rotation angle from the completion of an increase in angular velocity to the start of a decrease in angular velocity is (R22−R21).

The larger the value of (R22−R21), the longer a period during which the angular velocity of roller unit assumes Vrt22 becomes so that a difference between the first rotation angle θ1 and the second rotation angle θ2 is increased. The control unit 600 repeats the change of the range of the rotation angle from the rotation angle R21 to the rotation angle R22, and a process of checking the fluctuation ΔP of pressure detected in step S1304, thus adjusting the control waveform such that the fluctuation ΔP falls within the predetermined value Pdif. The control unit 600 identifies the value of (R22−R21) at which the fluctuation ΔP assumes a minimum value by increasing or decreasing the value of (R22−R21).

The value of (R22−R21) is adjusted by being increased or decreased such that the fluctuation ΔP falls within the predetermined value Pdif. Appropriately setting the initial value of (R22−R21) can shorten the adjustment time. In this embodiment, the initial value of (R22−R21) is set by the following procedure.

Figure 17:
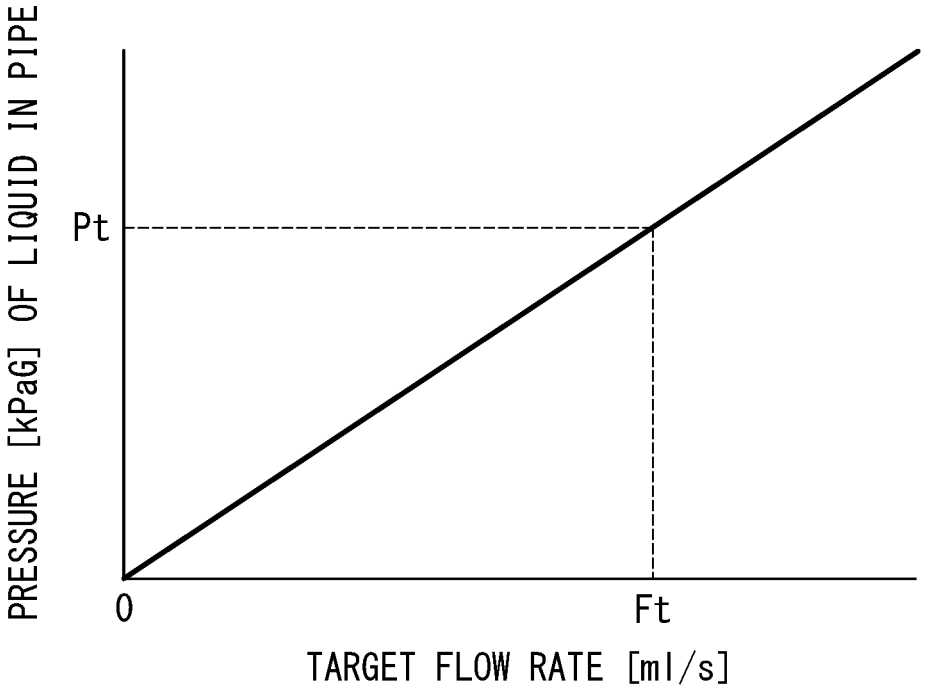
FIG. 17 is a graph showing a function of a target flow rate and a pressure of a liquid in a pipe.

Firstly, based on the target flow rate Ft instructed by the operator and based on a function of the target flow rate stored in the memory unit 610 and the pressure of a liquid in the pipe 200, the control unit 600 estimates a pressure Pt of the liquid in the pipe 200 from the target flow rate Ft. FIG. 17 is a graph showing a function of the target flow rate Ft and the pressure of a liquid in the pipe 200. The function (for example, a linear function with a target flow rate as a variable) shown in FIG. 17 is stored in advance in the memory unit 610.

Figure 18:
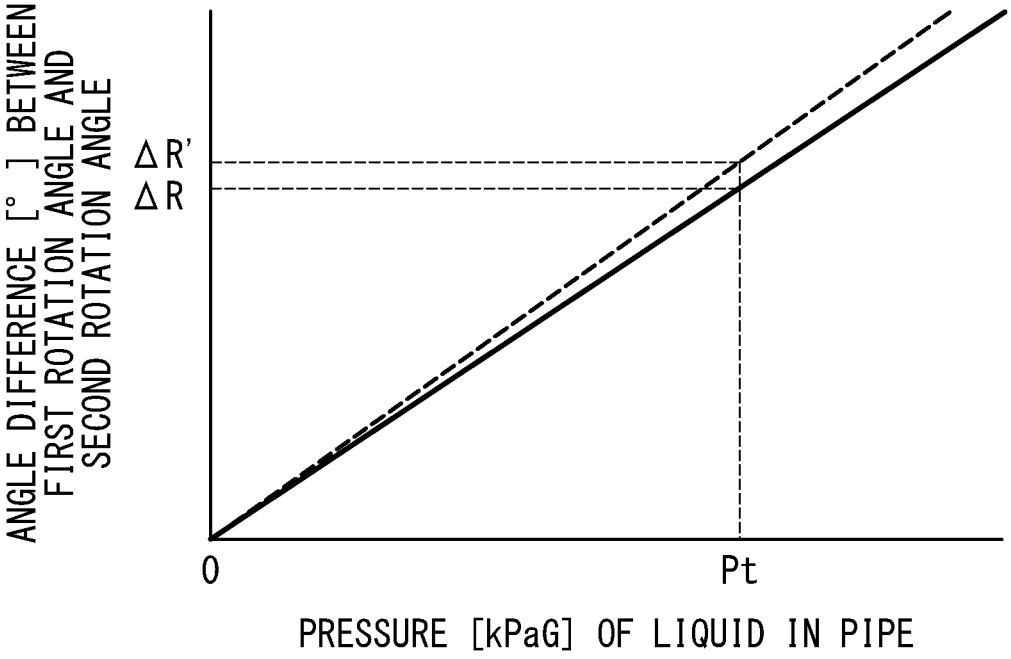
FIG. 18 is a graph showing the relationship between the pressure of the liquid in the pipe and an angle difference between a first rotation angle and a second rotation angle.

Secondly, based on the pressure Pt of the liquid in the pipe 200, which is estimated from the target flow rate Ft, and based on a function of the pressure of a liquid in the pipe 200 and an angle difference between the first rotation angle θ1 and the second rotation angle θ2, the function being stored in the memory unit 610, the control unit 600 estimates an angle difference ΔR which can be estimated from the pressure Pt. FIG. 18 is a graph showing the relationship between the pressure of a liquid in the pipe and the angle difference ΔR between the first rotation angle θ1 and the second rotation angle θ2. The function (for example, a linear function with a pressure as a variable) indicated by a solid line in FIG. 18 is stored in advance in the memory unit 610.

Thirdly, from the angle difference ΔR calculated from the target flow rate Ft, the control unit 600 sets an initial value of (R22−R21), which is a range of a rotation angle from the rotation angle R21 to the rotation angle R22. A function which indicates the relationship between the angle difference ΔR and (R22−R21) is stored in advance in the memory unit 610. The control unit 600 sets the value of (R22−R21) for realizing the angle difference ΔR, which is calculated from the target flow rate Ft, as the initial value.

In step S1307, the control unit 600 adjusts an angular velocity of the first roller unit 10 and the second roller unit 20 such that the flow rate per unit time of a liquid discharged to the pipe 200 from the end portion of the tube 101 is maintained at the target flow rate Ft (predetermined flow rate). The control unit 600 adjusts the angular velocities of the first roller unit 10 and the second roller unit 20 such that the larger the first rotation angle θ1, the lower an average angular velocity becomes, whereas the smaller the first rotation angle θ1, the higher an average angular velocity becomes. The reason the angular velocity of the first roller unit 10 and the second roller unit 20 is adjusted as described above is that the first rotation angle θ1 decides the amount of liquid closed in the tube 101 by the first roller unit 10 and the second roller unit 20.

The larger the first rotation angle θ1, the larger the amount of liquid which is closed in the tube 101 becomes. Whereas the smaller the first rotation angle θ1, the smaller the amount of liquid which is closed in the tube 101 becomes. The control unit 600 controls the angular velocity of the first roller unit 10 and the second roller unit 20 corresponding to the amount of liquid closed in the tube 101, thus maintaining the target flow rate Ft (predetermined flow rate).

As shown in FIG. 16, in the control waveform adjusted by the control unit 600, an angular velocity is increased from Vrt21 (first predetermined velocity) to Vrt22 (second predetermined velocity) in an angle range from the rotation angle R21 to the rotation angle R22. This angle range is included in a period from a point where the first roller unit 10 passes through the closing position Po1 to a point where the second roller unit 20 passes through the releasing position Po2. As described above, the control unit 600 causes a rotation angle formed between the first roller unit 10 and the second roller unit 20 to be gradually reduced in a state where the tube 101 is closed by the first roller unit 10 and the second roller unit 20. Accordingly, the second rotation angle θ2 is smaller than the first rotation angle θ1 so that the pressure of a liquid discharge to the pipe 200 is higher than the atmospheric pressure.

The example shown in FIG. 16 is an example where the rotation angle R21 agrees with the closing position Po1. However, there may be the case where the rotation angle R21 is an angle smaller than the closing position Po1 (an angle close to 0°), or the case where the rotation angle R21 is an angle larger than the closing position Po1. The rotation angle R21 is set to either of the rotation angle of the first roller unit 10 when the first roller unit 10 passes through the releasing position Po2 and is separated from the tube 101 or the rotation angle of the first roller unit 10 when the preceding second roller unit 20 passes through the releasing position Po2.

The value of (R22−R21) which is set when the control unit 600 determines YES in step S1305 is different from the value of (R22−R21) which is set as the initial value. This is because the tube 101 used for setting the initial value of (R22−R21) and the tube 101 used when (R22−R21) is actually adjusted differ from each other in conditions (a raw material, the degree of deterioration and the like).

Using an angle difference ΔR' between the first rotation angle θ1 and the second rotation angle θ2 introduced from the value of (R22−R21) which is set when the control unit 600 determines YES in step S1305, the control unit 600 corrects a function indicated by a solid line in FIG. 18, and stores a function indicated by a broken line in the memory unit 610. Using the function corrected in step S1303, the control unit 600 controls the first drive unit 50 and the second drive unit 60 based on the adjusted control waveform. The initial value of (R22−R21) is appropriately set and hence, an adjustment time for adjusting (R22−R21) is shortened.

Figure 19:
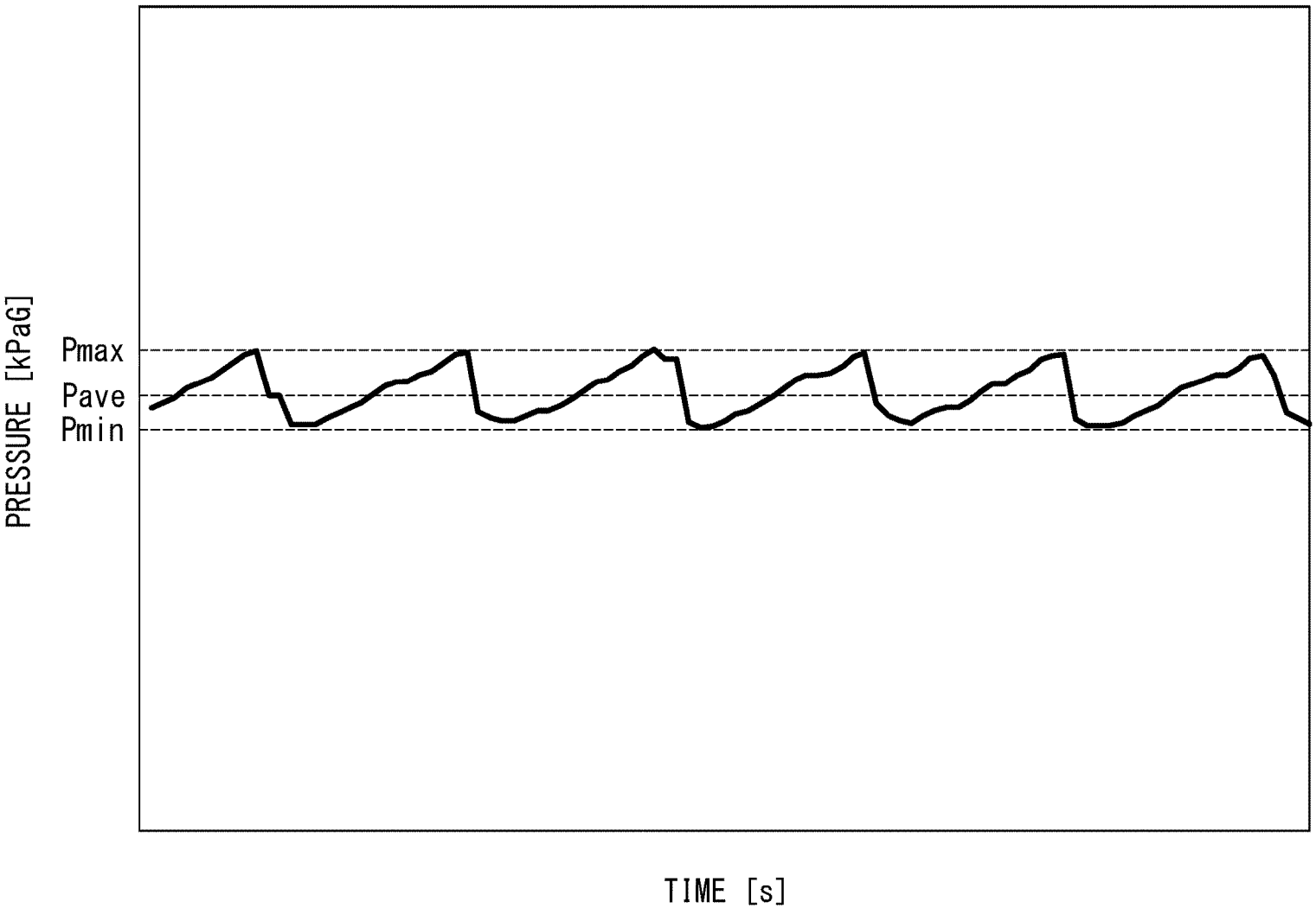
FIG. 19 is a graph showing one example of variation over time of a pressure detected by the pressure sensor when the drive unit is controlled based on a control waveform where the first rotation angle and the second rotation angle are adjusted.

FIG. 19 is a graph showing one example of variation over time of a pressure detected by the pressure sensor 300 when the control unit 600 controls the first drive unit 50 and the second drive unit 60 based on the control waveform where the first rotation angle θ1 and the second rotation angle θ2 are adjusted. The example shown in FIG. 19 shows variation of pressure when the first roller unit 10 and the second roller unit 20 are rotated through three revolutions around the axis line X1.

As shown in FIG. 19, a pressure detected by the pressure sensor 300 periodically fluctuates between the minimum value Pmin and the maximum value Pmax so that a fluctuation ΔP of pressure is Pmax-Pmin. Pave in FIG. 17 indicates the average value of pressure. The scale on an axis indicating pressure in FIG. 19 is identical to the scale on an axis indicating pressure in FIG. 15. The fluctuation ΔP of pressure shown in FIG. 19 falls within the predetermined value Pdif, and is smaller than the fluctuation ΔP of pressure shown in FIG. 15.

As described above, the control unit 600 adjusts the first rotation angle θ1 and the second rotation angle θ2, thus performing control such that a fluctuation ΔP of pressure assumes the predetermined value Pdif or less. When it is determined YES in step S1305, the control unit 600 advances the process to step S1308.

Figure 20:
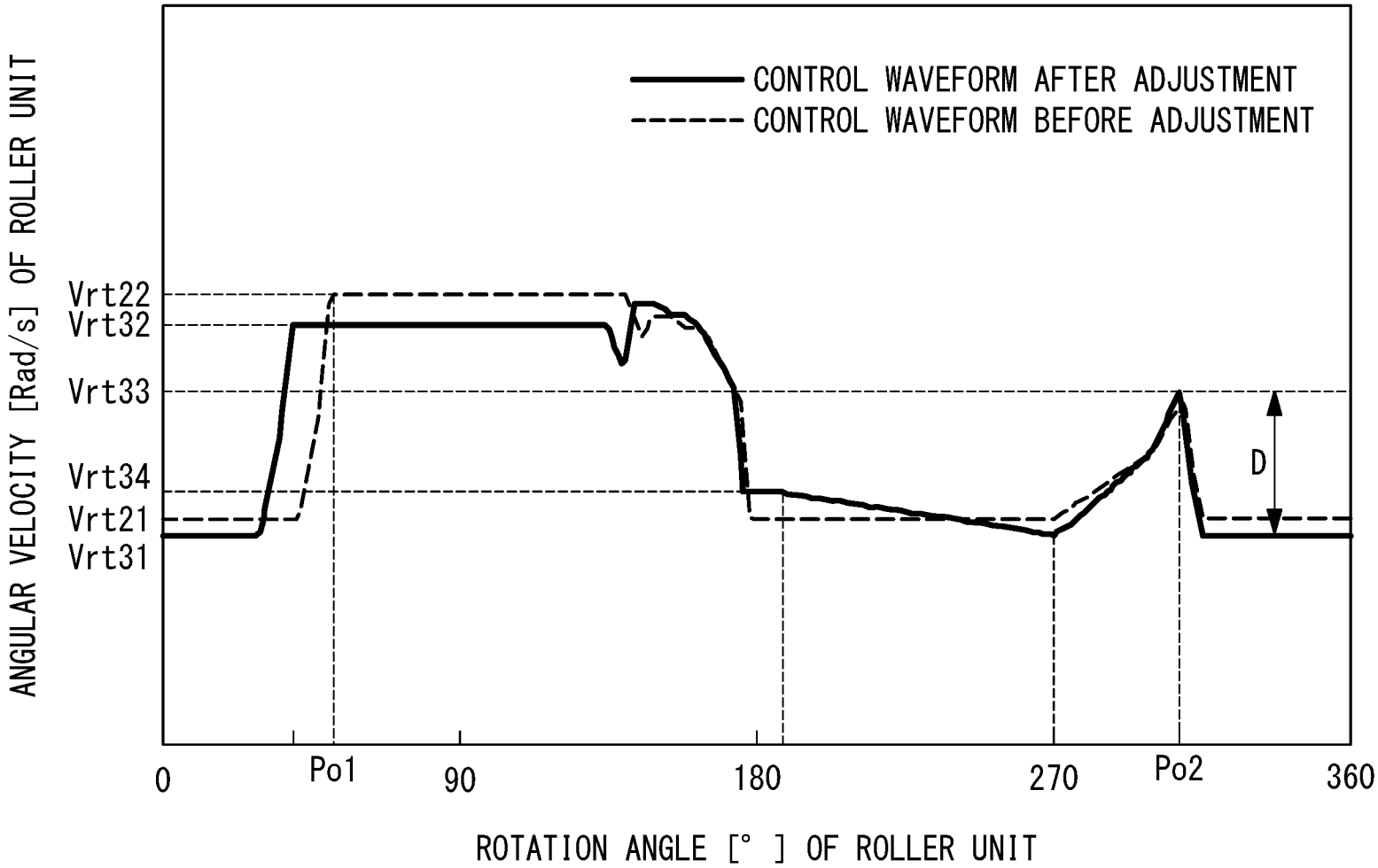
FIG. 20 is a graph showing a correspondence between a rotation angle of the roller unit and an angular velocity of the roller unit.

In step S1308 to step S1311, the fluctuation ΔP of pressure is the predetermined value Pdif or less and hence, the control unit 600 adjusts the control waveform to further reduce the fluctuation ΔP of pressure. FIG. 20 shows a correspondence of the rotation angle of the roller unit and the angular velocity of the roller unit. A control waveform before an adjustment is performed in step S1308 to step S1310 is indicated by a broken line, and a control waveform adjusted in step S1308 to step S1310 is indicated by a solid line.

As indicated by the solid line in FIG. 20, to increase the pressure of a liquid closed between the first roller unit 10 or the second roller unit 20 and the other preceding roller unit after the first roller unit 10 or the second roller unit 20 passes through the closing position Po1, an angular velocity is increased from Vrt31 (first predetermined velocity) to Vrt32 (second predetermined velocity). An angular velocity difference between Vrt31 and Vrt32 corresponds to the amount of an increase in angular velocity which is increased after the roller unit passes through the closing position Po1.

In step S1308, the control unit 600 adjusts an angular velocity difference D shown in FIG. 20. As indicated by the solid line in FIG. 20, when the first roller unit 10 or the second roller unit 20 passes through the releasing position Po2, an angular velocity of the roller unit is temporarily increased from Vrt31 to Vrt33. The angular velocity is increased so as to suppress a phenomenon that a fluid is drawn back from the downstream side of the releasing position Po2 toward the upstream side of the releasing position Po2 when a state where the roller unit compresses the tube 101 is released. The angular velocity difference D is an angular velocity difference between Vrt31 and Vrt33. The control unit 600 identifies the angular velocity difference D at which the fluctuation ΔP of pressure assumes an extremely small value by increasing or decreasing the angular velocity difference D.

The angular velocity difference D is adjusted by being increased or decreased such that the fluctuation ΔP assumes an extremely small value. Appropriately setting the initial value of the angular velocity difference D can shorten an adjustment time. In this embodiment, the initial value of the angular velocity difference D is set by the following procedure.

Figure 21:
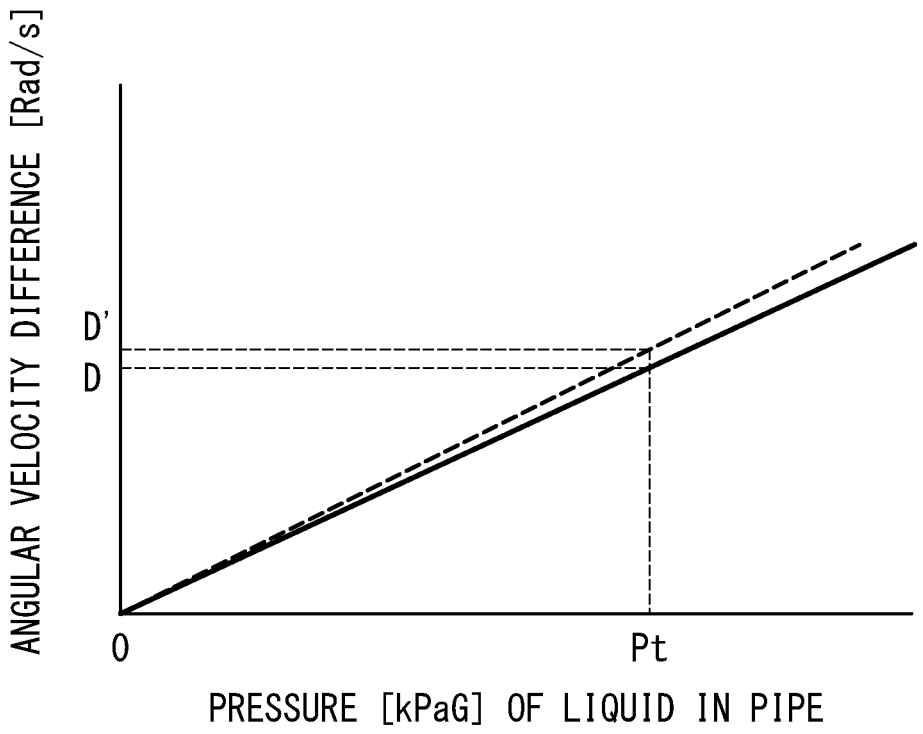
FIG. 21 is a graph showing a function of the pressure of the liquid and an angular velocity difference.

Based on the pressure Pt estimated from a function of a target flow rate and the pressure of a liquid in the pipe 200 shown in FIG. 17, and based on a function of the pressure Pt and the angular velocity difference D stored in the memory unit 610, the control unit 600 estimates the angular velocity difference D. FIG. 21 is a graph showing a function of the pressure Pt of a liquid and the angular velocity difference D. The function indicated by a solid line in FIG. 21 is stored in advance in the memory unit 610, and the control unit 600 sets the angular velocity difference D calculated from the target flow rate Ft as an initial value.

Each time step S1308 is performed where the angular velocity difference D is adjusted, the control unit 600 corrects the function indicated by a solid line in FIG. 21 using the adjusted angular velocity difference D', and stores a function indicated by a broken line in the memory unit 610. In step S1303, the control unit 600 controls the first drive unit 50 and the second drive unit 60 based on the adjusted control waveform using this corrected function. The initial value of the angular velocity difference D is appropriately set and hence, an adjustment time for adjusting the angular velocity difference D is shortened.

In step S1310, the control unit 600 controls the first drive unit 50 and the second drive unit 60 such that after the second roller unit 20 passes through the releasing position Po2, the angular velocity of the following first roller unit 10 which moves toward the releasing position Po2 is gradually decreased. In the same manner, the control unit 600 controls the first drive unit 50 and the second drive unit 60 such that after the first roller unit 10 passes through the releasing position Po2, the angular velocity of the following second roller unit 20 which moves toward the releasing position Po2 is gradually decreased.

As shown in FIG. 20, the control unit 600 causes, in a range of the rotation angle from 180° to 270°, the angular velocity of the roller unit which moves toward the releasing position Po2 to be gradually decreased from Vrt34 to Vrt31. This is because when the roller unit approaches the releasing position Po2, the volume of the tube 101 and the pipe 200 ranging from the roller unit to the needle valve 500 decreases and hence, the pressure of liquid on the downstream side of the roller unit rises. Pulsation can be suppressed by offsetting the pressure rise in the liquid on the downstream side of the roller unit which is caused by approach of the roller unit to the releasing position Po2 by a reduction in pressure caused by a decrease in the angular velocity of the roller unit.

In step S1310, the control unit 600 adjusts the angular velocity of the first roller unit 10 and the second roller unit 20 such that the flow rate per unit time of a liquid discharged to the pipe 200 from the end portion of the tube 101 is maintained at the target flow rate Ft (predetermined flow rate). The control unit 600 adjusts the angular velocity of the first roller unit 10 and the second roller unit 20 such that the larger the first rotation angle θ1, the lower an average angular velocity becomes, whereas the smaller the first rotation angle θ1, the higher the average angular velocity becomes. The reason the angular velocity of the first roller unit 10 and the second roller unit 20 is adjusted as described above is that the first rotation angle θ1 decides the amount of liquid closed in the tube 101 by the first roller unit 10 and the second roller unit 20.

In step S1311, the control unit 600 determines whether or not the target flow rate Ft is changed or the finish of the control is instructed by the operator. When the determination is YES, the process of this flowchart is finished. When the determination is NO, the control unit 600 repeats the process following after step S1304.

Figure 22:
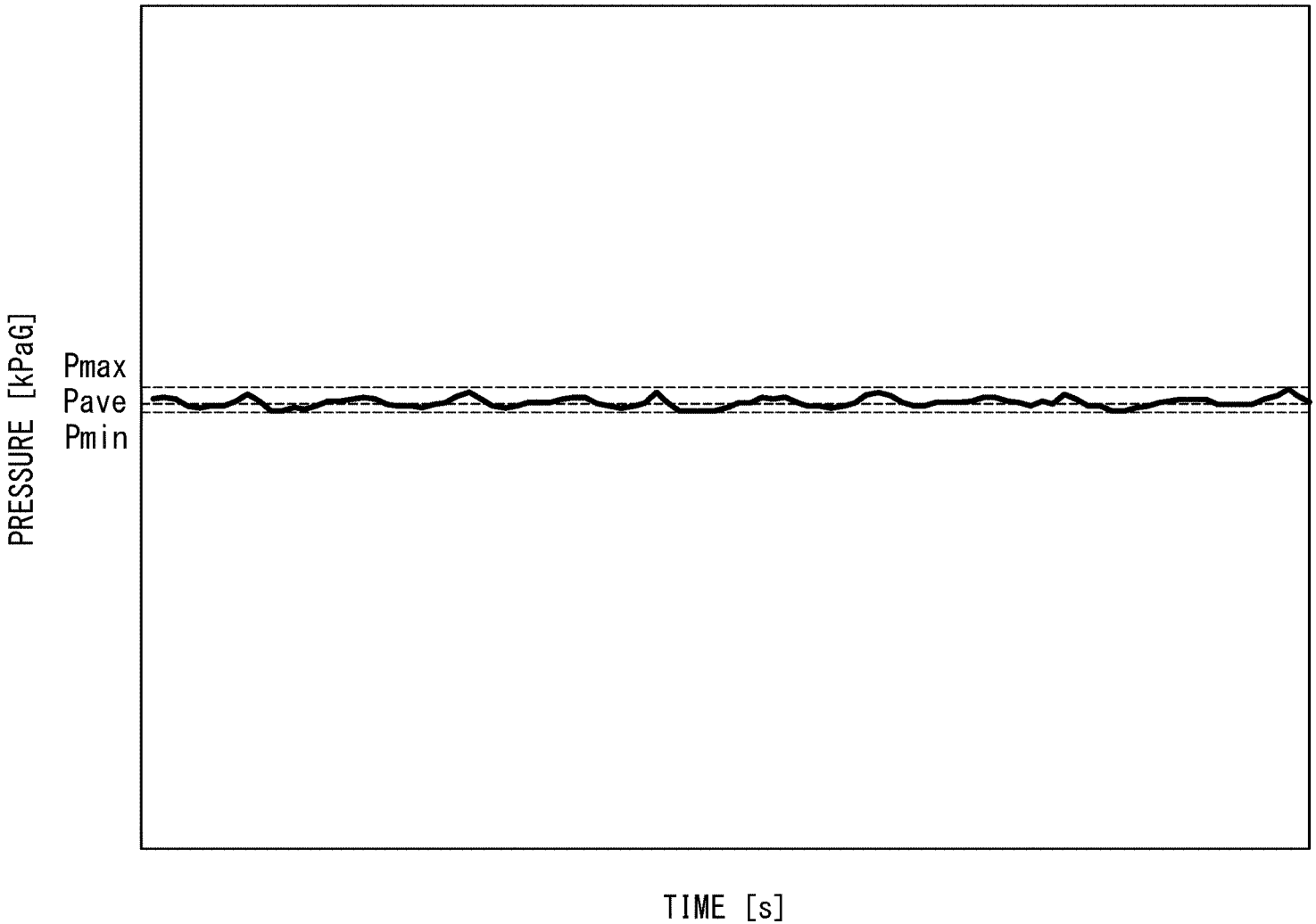
FIG. 22 is a graph showing one example of variation over time of a pressure detected by the pressure sensor when the drive unit is controlled based on the adjusted control waveform.

FIG. 22 is a graph showing one example of variation over time of a pressure detected by the pressure sensor 300 when the first drive unit 50 and the second drive unit 60 are controlled based on the control waveform adjusted in step S1308 to step S1310. The example shown in FIG. 22 shows variation of pressure when the first roller unit 10 and the second roller unit 20 are rotated through three revolutions around the axis line X1.

As shown in FIG. 22, a pressure detected by the pressure sensor 300 periodically fluctuates between the minimum value Pmin and the maximum value Pmax so that a fluctuation ΔP of pressure is Pmax-Pmin. Pave shown in FIG. 22 indicates the average value of pressure. Pave shown in FIG. 22 has the same value as Pave shown in FIG. 19 and FIG. 15.

The scale on an axis indicating pressure in FIG. 22 is identical to the scale on an axis indicating pressure in FIG. 19 and FIG. 15. The fluctuation ΔP of pressure shown in FIG. 22 falls within the predetermined value Pdif, and is smaller than the fluctuation ΔP of pressure shown in FIG. 19. As described above, the control unit 600 performs a control such that the fluctuation ΔT of pressure is further decreased from the predetermined value Pdif by repeating the adjustment performed in step S1308 to step S1311.

The description will be made with respect to the manner of operation and advantageous effects of the above-described tube pump system 700 of this embodiment.

According to the tube pump system 700 of this embodiment, the pair of roller units are respectively rotated by the pair of drive units around the axis line X1 in the same direction and hence, the pair of roller units reach the releasing position Po2 from the closing position Po1 in a state of compressing the tube 101. The control unit 600 controls each of the pair of drive units, thus causing a liquid which flows into the tube 101 from one end of the tube 101 to be discharged from the other end of the tube 101.

The fluctuation of the pressure of liquid detected by the pressure sensor 300 when the pair of roller units rotate through at least one revolution indicates the magnitude of the pulsation of a liquid supplied by the tube pump system 700 under pressure. When one of the pair of roller units passes through the releasing position Po2 and the tube 101 compressed by the roller unit returns to the original shape, the larger a pressure difference between the pressure of liquid on the downstream side of the releasing position Po2 and the pressure of liquid on the upstream side of the releasing position Po2, the larger the fluctuation of the pressure becomes.

The pressure difference between liquid on the downstream side of the releasing position Po2 and liquid on the upstream side of the releasing position Po2 corresponds to the first rotation angle θ1 and the second rotation angle θ2. That is, the larger a difference between the first rotation angle θ1 and the second rotation angle θ2, the higher the pressure of a liquid in the tube 101 which is closed by contact with the pair of roller units becomes. The smaller a difference between the first rotation angle θ1 and the second rotation angle θ2, the lower the pressure of a liquid in the tube which is closed by contact with the pair of roller units becomes.

Accordingly, in the tube pump system 700 of this embodiment, the control unit 600 controls the first rotation angle θ1 around the axis line X1 and the second rotation angle θ2 around the axis line X1 such that the fluctuation ΔP of a pressure detected by the pressure sensor 300 falls within the predetermined value Pdif, the first rotation angle θ1 being formed between the pair of roller units when the first roller unit 10 passes through the closing position Po1, and the second rotation angle θ2 being formed between the pair of roller units when the second roller unit 20 passes through the releasing position Po2. According to the tube pump system 700 of this embodiment, even when the pulsation state dynamically varies, pulsation can be appropriately suppressed in correspondence with such variation.

According to the tube pump system 700 of this embodiment, a rotation angle formed between the pair of roller units which close the tube 101 is reduced to the rotation angle formed between a point where the closed state of the tube 101 is started and a point where the closed state of the tube 101 is released. Accordingly, it is possible to cause the pressure of a liquid in the tube 101 to rise to a desired pressure.

According to the tube pump system 700 of this embodiment, the angular velocity of the following first roller unit 10 is increased from the first predetermined velocity to the second predetermined velocity and hence, the rotation angle formed between the pair of roller units which close the tube 101 can be reduced to a rotation angle formed between a point where the closed state of the tube 101 is started and a point where the closed state of the tube 101 is released.

In the tube pump system 700 of this embodiment, after the second roller unit 20 passes through the releasing position Po2, the angular velocity of the first roller unit 10 which moves toward the releasing position Po2 is gradually decreased. Accordingly, the pressure rise of liquid on the upstream side which is caused by approach of the first roller unit 10 to the releasing position Po2 can be offset by a decrease in the pressure of liquid which is caused by a decrease in the angular velocity of the first roller unit 10. Further, according to the tube pump system 700 of this embodiment, control is performed such that, after the fluctuation ΔP of the pressure of liquid falls within the predetermined value Pdif, the angular velocity of the first roller unit 10 which moves toward the releasing position Po2 is gradually decreased. According to the tube pump system 700 of this embodiment, pulsation can be promptly suppressed with high accuracy compared with the case where such control is performed when the fluctuation ΔP of the pressure of liquid is larger than the predetermined value Pdif.

In the tube pump system 700 of this embodiment, the control unit 600 adjusts the angular velocity of each of the pair of roller units corresponding to the first rotation angle θ1 such that the flow rate per unit time of a liquid discharged from the other end of the tube 101 is maintained at the target flow rate Ft. Accordingly, for example, even when the first rotation angle θ1 and the second rotation angle θ2 are controlled to suppress pulsation, the flow rate per unit time of a liquid discharged from the other end of the tube 101 is maintained at a predetermined flow rate. Therefore, it is possible to suppress that the pulsation state varies with variation of the flow rate of a liquid and hence, pulsation can be appropriately suppressed within a short time.

What is claimed is:

1. A tube pump system comprising:

a housing unit which has an inner peripheral surface formed into a circular-arc shape around an axis line;

a tube having flexibility which is arranged along the inner peripheral surface;

a pair of roller units which are housed in the housing unit, and are rotated around the axis line from a closing position to a releasing position around the axis line in a state where the pair of roller units close the tube;

a pair of drive units which are configured to respectively rotate the pair of roller units around the axis line in a same direction;

a control unit which is configured to control each of the pair of drive units such that a liquid which flows into the tube from one end of the tube is discharged from the other end of the tube; and a pressure detection unit which is configured to detect a pressure of a liquid in a pipe connected to the other end of the tube, wherein the control unit is configured to control a first rotation angle around the axis line and a second rotation angle around the axis line based on the pressure of the liquid detected by the pressure detection unit such that fluctuation of the pressure of the liquid detected by the pressure detection unit when the pair of roller units are rotated through at least one revolution falls within a predetermined value, the first rotation angle being formed between the pair of roller units when a first roller unit of the pair of roller units passes through the closing position, and the second rotation angle being formed between the pair of roller units when a second roller unit of the pair of roller units passes through the releasing position; and a memory unit, wherein the control unit is configured to cause the memory unit to store the pressure detected by the pressure detection unit when the first roller unit and the second roller unit are rotated around the axis line through at least one revolution, to determine whether or not the fluctuation of the pressure of the liquid detected by the pressure detection unit falls within the predetermined value, and to control the first rotation angle and the second rotation angle based on the pressure of the liquid detected by the pressure detection unit such that the fluctuation of the pressure of the liquid falls within the predetermined value when it is determined that the fluctuation of the pressure does not fall within the predetermined value.

2. The tube pump system according to claim 1, wherein the control unit performs a control such that the second rotation angle becomes smaller than the first rotation angle.

3. The tube pump system according to claim 2, wherein the control unit increases an angular velocity of the first roller unit from a first predetermined velocity to a second predetermined velocity in a period from a point where the first roller unit passes through the closing position to a point where the second roller unit passes through the releasing position.

4. The tube pump system according to claim 1, wherein the control unit controls the pair of drive units such that, as the fluctuation falls within the predetermined value, an angular velocity of the first roller unit which moves toward the releasing position is gradually decreased after the second roller unit passes through the releasing position.

5. The tube pump system according to claim 1, wherein the control unit adjusts the angular velocity of each of the pair of roller units corresponding to the first rotation angle such that a flow rate per unit time of a liquid discharged from the other end of the tube is maintained at a predetermined flow rate.

6. A method for controlling a tube pump system including: a housing unit which has an inner peripheral surface formed into a circular-arc shape around an axis line; a tube having flexibility which is arranged along the inner peripheral surface; a pair of roller units which are housed in the housing unit, and are rotated around the axis line from a closing position to a releasing position around the axis line in a state where the pair of roller units close the tube; and a pair of drive units which are configured to respectively rotate the pair of roller units around the axis line in a same direction, the method comprising:

a controlling step where each of the pair of drive units is controlled such that a liquid which flows into the tube from one end of the tube is discharged from the other end of the tube; and a pressure detecting step where a pressure of a liquid in a pipe connected to the other end of the tube is detected, wherein in the controlling step, a first rotation angle around the axis line and a second rotation angle around the axis line are controlled based on the pressure of the liquid detected by the pressure detecting step such that fluctuation of the pressure of the liquid detected in the pressure detecting step when the pair of roller units are rotated through at least one revolution falls within a predetermined value, the first rotation angle being formed between the pair of roller units when a first roller unit of the pair of roller units passes through the closing position, and the second rotation angle being formed between the pair of roller units when a second roller unit of the pair of roller units passes through the releasing position; and wherein the control step causes a memory unit to store the pressure detected by the pressure detection step when the first roller unit and the second roller unit are rotated around the axis line through at least one revolution, the control step determines whether or not the fluctuation of the pressure of the liquid detected by the pressure detection step falls within the predetermined value, and the control step controls the first rotation angle and the second rotation angle based on the pressure of the liquid detected by the pressure detection step such that the fluctuation of the pressure of the liquid falls within the predetermined value when it is determined that the fluctuation of the pressure does not fall within the predetermined value.

7. The method for controlling the tube pump system according to claim 6, wherein the control step performs a control such that the second rotation angle becomes smaller than the first rotation angle.

8. The method for controlling the tube pump system according to claim 7, wherein the control step increases an angular velocity of the first roller unit from a first predetermined velocity to a second predetermined velocity in a period from a point where the first roller unit passes through the closing position to a point where the second roller unit passes through the releasing position.

9. The method for controlling the tube pump system according to claim 6, wherein the control step controls the pair of drive units such that, as the fluctuation falls within the predetermined value, an angular velocity of the first roller unit which moves toward the releasing position is gradually decreased after the second roller unit passes through the releasing position.

10. The method for controlling the tube pump system according to claim 6, wherein the control step adjusts the angular velocity of each of the pair of roller units corresponding to the first rotation angle such that a flow rate per unit time of a liquid discharged from the other end of the tube is maintained at a predetermined flow rate.

* * * * *